US010317818B2

(12) United States Patent
Taniya

(10) Patent No.: US 10,317,818 B2
(45) Date of Patent: Jun. 11, 2019

(54) IMAGE FORMING APPARATUS INCLUDING DETACHABLY DISPOSED DRIVE UNIT

(71) Applicant: SHARP KABUSHIKI KAISHA, Sakai, Osaka (JP)

(72) Inventor: Keisuke Taniya, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 15/952,481

(22) Filed: Apr. 13, 2018

(65) Prior Publication Data

US 2018/0299804 A1 Oct. 18, 2018

(30) Foreign Application Priority Data

Apr. 14, 2017 (JP) ..... 2017-080830

(51) Int. Cl.
*G03G 21/16* (2006.01)
*G03G 15/08* (2006.01)
*G03G 15/00* (2006.01)

(52) U.S. Cl.
CPC ..... *G03G 15/0889* (2013.01); *G03G 15/80* (2013.01); *G03G 21/1619* (2013.01); *G03G 21/1647* (2013.01); *G03G 2215/0802* (2013.01); *G03G 2221/1657* (2013.01); *G03G 2221/1678* (2013.01)

(58) Field of Classification Search
CPC ..... G03G 15/0889; G03G 15/0887; G03G 15/80; G03G 21/1619; G03G 21/1647; G03G 21/1661; G03G 2215/0802; G03G 2221/1678
See application file for complete search history.

(56) References Cited

U.S. PATENT DOCUMENTS

2006/0197827 A1 9/2006 Tokuzaki
2007/0231007 A1* 10/2007 Arakawa ..... G03G 15/757 399/167
2010/0209144 A1* 8/2010 Nieda ..... G03G 21/1647 399/167
2010/0278559 A1* 11/2010 Komatsu ..... G03G 21/1647 399/167
2018/0164713 A1* 6/2018 Mimura ..... G03G 21/1647

FOREIGN PATENT DOCUMENTS

JP 2006-243533 A 9/2006

* cited by examiner

*Primary Examiner* — Sophia S Chen
(74) *Attorney, Agent, or Firm* — ScienBiziP, P.C.

(57) ABSTRACT

An image forming apparatus includes a rear-side frame member that is disposed on the rear side of an image forming apparatus body so as to extend in a vertical or substantially vertical direction; and a drive unit that includes a drive part. The drive unit is detachably disposed on an inner surface of the rear-side frame member such that the drive part faces outward from the image forming apparatus body.

20 Claims, 22 Drawing Sheets

-Related Art-

-Related Art-

IMAGE FORMING APPARATUS INCLUDING DETACHABLY DISPOSED DRIVE UNIT

BACKGROUND

1. Field

The present disclosure relates to an image forming apparatus such as a copying machine, a multifunction machine, a printer, and a facsimile machine and particularly relates to an image forming apparatus including a rear-side frame member that is disposed, in a vertical or substantially vertical direction, on the rear side of an image forming apparatus body and a drive unit that includes a drive part that drives a component member of the image forming apparatus body.

2. Description of the Related Art

In general, a known image forming apparatus is configured, for example, as described below.

FIG. 23 is a schematic plan view illustrating a state in which a drive unit 20X is to be disposed on an outer surface 110Xa of a rear-side frame member 110X of a known image forming apparatus 100X. FIG. 24 is a schematic perspective view, obliquely from above and on a rear side Y2, illustrating a state in which the drive unit 20X illustrated in FIG. 23 is disposed on the outer surface 110Xa of the rear-side frame member 110X.

As illustrated in FIGS. 23 and 24, in the known image forming apparatus 100X, the drive unit 20X that includes a drive part 21X (for example, an electric drive part (specifically, a drive motor) that uses electric power for driving) is disposed on the outer surface 110Xa of the rear-side frame member 110X disposed on the rear side Y2 of an image forming apparatus body 1X so as to extend in a vertical or substantially vertical direction. The drive part 21X drives a component member (for example, a toner supply member (not illustrated) of a toner storage part) of the image forming apparatus body 1X. In addition, a large number of other component members that are not illustrated (for example, electric components, substrates, and wires that connect these component members to each other) are densely disposed on the outer surface 110Xa of the rear-side frame member 110X. Specifically, there is a case where the drive unit 20X is disposed on the outer surface 110Xa of the rear-side frame member 110X and the electric components and/or the substrates (not illustrated) are disposed at the rear of the drive unit 20X.

It is not easy, in the image forming apparatus 100X in such a state, to perform maintenance work, such as cleaning and replacement, of the drive unit 20X covered by the other component members (not illustrated) because the maintenance work is performed from the rear side Y2 of the image forming apparatus body 1X, which degrades maintainability of the drive unit 20X.

In this respect, Japanese Unexamined Patent Application Publication No. 2006-243533 (hereinafter referred to as Patent Document 1) discloses (refer to paragraph [0034] and FIGS. 2 and 3 in Patent Document 1) a configuration in which a drive unit is detachably disposed on an inner surface of a rear-side frame member.

According to the configuration described in Patent Document 1, it is possible to perform maintenance work, such as cleaning and replacement, of the drive unit from the front side of an image forming apparatus body because the drive unit is detachably disposed on the inner surface of the rear-side frame member. As a result, it is possible to easily perform the maintenance work of the drive unit, which improves maintainability of the drive unit.

In the configuration described in Patent Document 1, however, a component member (for example, a unit for image formation, such as a photoreceptor unit) disposed in the image forming apparatus body easily interferes with a drive part of the drive unit because the drive unit is disposed on the inner surface of the rear-side frame member such that the drive part faces the inside of the image forming apparatus body. For example, the component member disposed in the image forming apparatus body is easily affected by the heat generated at the drive part.

SUMMARY

It is desirable to provide an image forming apparatus capable of avoiding interference between a component member disposed in an image forming apparatus body and a drive part of a drive unit while improving maintainability of the drive unit.

According to an aspect of the disclosure, an image forming apparatus includes a rear-side frame member that is disposed on a rear side of an image forming apparatus body so as to extend in a vertical or substantially vertical direction; and a drive unit that includes a drive part, the drive unit being detachably disposed on an inner surface of the rear-side frame member such that the drive part faces outward from the image forming apparatus body.

DESCRIPTION OF THE EMBODIMENTS

Hereinafter, an embodiment of the present disclosure will be described with reference to the drawings.

Image Forming Apparatus

Figure 1:
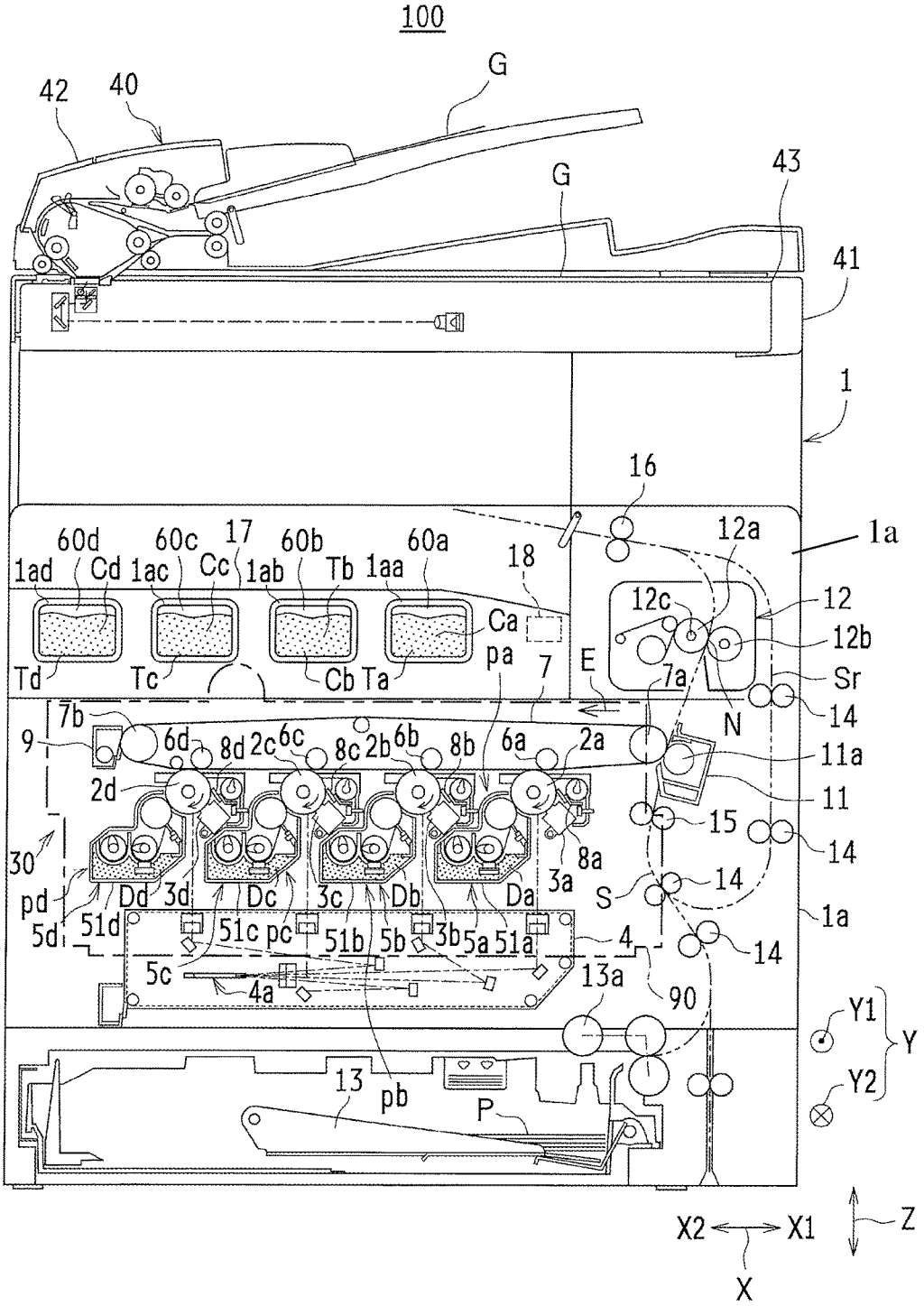
FIG. 1 is a schematic sectional view illustrating an internal structure of an image forming apparatus according to as embodiment of the present disclosure.

FIG. 1 is a schematic sectional view illustrating an internal structure of an image forming apparatus 100 according to an embodiment of the present disclosure.

The image forming apparatus 100 according to the present embodiment is a color-image forming apparatus having a configuration, which is commonly known as a tandem-type, in which a plurality of electrostatic latent image carriers (specifically, photoreceptor), on each of which a toner image is to be formed, are disposed substantially parallel to each other in a specific direction (in the present embodiment, a left-right direction X). The image forming apparatus 100 is, for example, an intermediate transfer-type color multifunction machine capable of forming a full-color image. The image forming apparatus 100 in the present embodiment is the tandem-type color-image forming apparatus; however, the image forming apparatus 100 may be a color-image forming apparatus of a different type. In addition, the image forming apparatus 100 in the present embodiment is the color-image forming apparatus; however, the image forming apparatus 100 may be a monochromatic-image forming apparatus.

The image forming apparatus 100 uses toners Ta, Tb, Tc, and Td (hereinafter referred to as Ta to Td) to form an image at an image forming part 30 provided in an image forming apparatus body 1 and collects waste toner discharged from the image forming part 30, in a toner collection container 90 that is detachably attached to the image forming apparatus body 1. Note that the one-dot chain line in FIG. 1 indicates the toner collection container 90.

Specifically, the image forming apparatus 100 forms an image, at the image forming part 30, by using the toners Ta to Td that are supplied from respective toner storage parts (specifically, toner cartridges) 60*a*, 60*b*, 60*c*, and 60*d* (hereinafter also referred to as 60*a* to 60*d*) detachably attached to the image forming apparatus body 1.

The image forming apparatus 100 is an electrophotographic image forming apparatus and includes a plurality of (four in the present embodiment) image forming stations pa, pb, pc, and pd (hereinafter also referred to as pa to pd); an exposure device 4 (specifically, an exposure unit); a plurality of (four in the present embodiment) first transfer devices (specifically, first transfer units) 6*a*, 6*b*, 6*c*, and 6*d* (hereinafter referred to as 6*a* to 6*d*); an intermediate transfer belt 7 as a toner image carrier that carries a toner image; a belt-cleaning device 9 (specifically, a belt-cleaning unit); a second transfer device 11 (specifically, a second transfer unit); a fixing device 12 (specifically, a fixing unit); a recording material storage part (specifically, a sheet-feeding device 13) that stores a recording material P, for example, a recording sheet; and a body frame 1*a*. The body frame 1*a* supports component members, such as the image forming stations pa to pd, the exposure device 4, the first transfer devices 6*a* to 6*d*, the second transfer device 11, and the fixing device 12, of the image forming apparatus body 1 and constitutes a housing and a support frame of the image forming apparatus body 1. In the present embodiment, the image forming stations pa to pd, the exposure device 4, and the first transfer devices 6*a* to 6*d* constitute the image forming part 30. Note that the second transfer device 11 and/or the fixing device 12 may also constitute the image forming part 30.

The image forming apparatus 100 includes an image reading device 40 that is disposed on an upper portion of the image forming apparatus body 1. The image reading device 40 includes an image reading part 41 for reading an image on a document G, a document transport part 42 that transports the document G, and a document placement table 43 on which the document G is placed.

The image reading device 40 reads, at the image reading part 41, the document G transported by the document transport part 42 or reads, at the image reading part 41, the document G placed on the document placement table 43. The image on the document G read by the image reading device 40 is sent as image data to the image forming apparatus body 1, or image data from an external apparatus is sent to the image forming apparatus body 1. An image that is formed, in the image forming apparatus body 1, in accordance with the image data is recorded on the recording material P.

A plurality of (four in the present embodiment) photoreceptors (specifically, photoreceptor drums) 2*a*, 2*b*, 2*c*, and 2*d* (hereinafter also referred to as 2*a* to 2*d*), which act as electrostatic latent image carriers, charging devices (specifically, charging units) 3*a*, 3*b*, 3*c*, and 3*d* (hereinafter also referred to as 3*a* to 3*d*), developing devices (specifically, developing units) 5*a*, 5*b*, 5*c*, and 5*d* (hereinafter also referred to as 5*a* to 5*d*), and photoreceptor cleaning devices (specifically, photoreceptor cleaning units) 8*a*, 8*b*, 8*c*, and 8*d* (hereinafter referred to as 8*a* to 8*d*) are included in the respective image forming stations pa to pd. The charging devices 3*a* to 3*d*, the developing devices 5*a* to 5*d*, and the photoreceptor cleaning devices 8*a* to 8*d* are disposed, in this order, around the respective photoreceptors 2*a* to 2*d*.

The toner storage parts 60*a* to 60*d* are detachably connected to the corresponding developing devices 5*a* to 5*d* of the image forming stations pa to pd. The toner storage parts 60*a*, 60*b*, 60*c*, and 60*d* store the black (B) toner Ta, the cyan toner Tb, the magenta (M) toner Tc, and the yellow (Y) toner Td, respectively. While the toners Ta to Td are supplied from the respective toner storage parts 60*a* to 60*d* to the corresponding developing devices 5*a* to 5*d*, the image forming stations pa, pb, pc, and pd form a black (B) toner image, a cyan (C) toner image, a magenta (M) toner image, and a yellow (Y) toner image, respectively, on the photoreceptors 2*a*, 2*b*, 2*c*, and 2*d*, by using respective developing agents Da, Db, Dc, and Dd (hereinafter also referred to as Da to Dd) of each color in the developing devices 5*a* to 5*d*. In the present embodiment, the developing agents Da to Dd are two-component developing agents that contain, as components, the respective toner Ta to Td and respective carriers Ca, Cb, Cc, and Cd (hereinafter referred to as Ca to Cd).

The toner collection container 90 and the toner storage parts 60*a* to 60*d* are detachable from the image forming apparatus body 1. As a result, a user is enabled to replace the toner collection container 90 and the toner storage parts 60*a* to 60*d*, as necessary.

Specifically, the image forming apparatus body 1 has insertion holes 1*aa*, 1*ab*, 1*ac*, and 1*ad* (hereinafter referred to as 1*aa* to 1*ad*) extending in a depth direction Y and into which the respective toner storage parts 60*a* to 60*d* are inserted in the depth direction Y. The depth direction Y indicates a direction from an operation side (in the present embodiment, a front side Y1 of the image forming apparatus body 1) of the image forming part 30 to a side opposite (in the present embodiment, the rear side Y2 of the image forming apparatus body 1) to the operation side and a direction from the side opposite to the operation side of the image forming part 30 to the operation side. In the present embodiment, the direction from the rear side Y2 of the image forming apparatus 100 to the front side Y1 thereof is one direction side of the depth direction Y, and the direction from the front side Y1 of the image forming apparatus 100 to the rear side Y2 thereof is the other direction side of the depth direction Y. In addition, a right side X1 in the left-right direction X in the view from the front side Y1 is one side, and a left side X2 in the left-right direction X in the view from the front side Y1 is the other side.

The toner storage parts 60*a* to 60*d* are configured to be attached to the image forming apparatus body 1 by being inserted, in the depth direction Y toward the rear side Y2, into the respective insertion holes 1*aa* to 1*ad* of the image forming apparatus body 1. In addition, the toner storage parts 60*a* to 60*d* are configured to be detached from the image forming apparatus body 1 by being extracted from the front side Y1 (the operation side in the present embodiment) in the depth direction Y. The toner storage parts 60*a* to 60*d* have respective toner replenishing ports 64 (refer to FIG. 4, mentioned later). The toner replenishing port 64 communicate, while the corresponding toner storage parts 60*a* to 60*d* are attached to the image forming apparatus body 1, with respective toner supply ports 551 (refer to FIG. 4) of the developing device 5*a*, 5*b*, 5*c*, and 5*d* via respective toner replenishing paths 61*a* (refer to FIGS. 3 and 4, mentioned later).

The toner storage parts 60*a* to 60*d* are disposed substantially parallel to each other in the left-right direction X, which is perpendicular to the depth direction Y. The image forming part 30 is disposed below the toner storage parts 60*a* to 60*d*.

The charging devices 3*a* to 3*d* evenly charge the surfaces of the photoreceptors 2*a* to 2*d* corresponding thereto. The exposure device 4 exposes, to light, the surfaces of the photoreceptors 2*a* to 2*d* evenly changed by the charging devices 3*a* to 3*d* and thereby forms electrostatic latent images on the surfaces of the photoreceptors 2*a* to 2*d*. The developing devices 5*a* to 5*d* include respective development tanks 51*a* to 51*d* that store the developing agents Da to Dd corresponding thereto. The developing devices 5*a* to 5*d* develop the electrostatic latent images, which have been formed on the surfaces of the photoreceptors 2*a* to 2*d* by the exposure device 4, by using the respective developing agents Da to Dd, and thereby make the electrostatic latent images visible.

The first transfer devices 6*a* to 6*d* first transfer the toner images formed on the photoreceptors 2*a* to 2*d* onto the intermediate transfer belt 7.

Each of the photoreceptor cleaning devices 8*a* to 8*d* is provided with a cleaning member (specifically, a cleaning blade). The photoreceptor cleaning devices 8*a* to 8*d* use the respective cleaning members to collect, as waste toner, residual toner that has not been transferred onto the intermediate transfer belt 7 by the first transfer devices 6*a* to 6*d* and that remains on the surfaces of the photoreceptors 2*a* to 2*d*. Then, the photoreceptor cleaning devices 8*a* to 8*d* transport the waste toner to the toner collection container 90.

The second transfer device 11 second transfers, onto the recording material P, the toner images that have been first transferred onto the intermediate transfer belt 7. In the present embodiment, the second transfer device 11 is provided with a second transfer roller 11*a*. The second transfer roller 11*a* electrostatically transfers, onto the recording material P, the toner images that have been transferred onto the intermediate transfer belt 7 by the first transfer devices 6*a* to 6*d*, thereby forming unfixed toner images.

The belt-cleaning device 9 collects, as the waste toner, the residual toner that has not been transferred onto the recording material P by the second transfer device 11 and that remains on the intermediate transfer belt 7. Then, the belt-cleaning device 9 transports the waste toner to the toner collection container 90.

The toner collection container 90 is disposed on the front side Y1 (operation side in the present embodiment) in the depth direction Y. The waste toner that has been transported from the photoreceptor cleaning devices 8*a* to 8*d* and the belt-cleaning device 9 is collected in the toner collection container 90.

The intermediate transfer belt 7 is disposed opposite the photoreceptors 2*a* to 2*d*. The intermediate transfer belt 7 is stretched over a drive roller 7*a* and a driven roller 7*b*. When the driven roller 7*a* is rotationally driven, the intermediate transfer belt 7 is rotated (moved in a circular manner) in a predetermined rotation direction E. The second transfer device 11 and the belt-cleaning device 9 are disposed adjacent to the intermediate transfer belt 7 so as to be on the side of the drive roller 7*a* and on the side of the driven roller 7*b*, respectively.

The exposure device 4 is configured to scan the surfaces of the photoreceptors 2*a* to 2*d*, which are each rotationally driven in a predetermined direction, in a scanning direction (rotational axis direction of the photoreceptors) with four light beams (specifically, laser beams) from a light source portion 4*a* that includes a polygonal mirror. The exposure device 4 forms an electrostatic latent image on each of the surfaces of the photoreceptors 2*a* to 2*d* in accordance with externally input image data corresponding to a color image in which colors of a black (B) component, a cyan (C) component, a magenta (M) component, and a yellow (Y) component are used or in accordance with externally input image data corresponding to a monochromatic image in which a single color (for example, black) is used.

The fixing device 12 fixes, by using heat and pressure, the unfixed toner images transferred on the recording material P by the second transfer device 11 to the recording material P. Specifically, the fixing device 12 includes a heat source 12*c*, such as a heater, a fixing roller 12*a*, and a pressure roller 12*b* in pressure contact with the fixing roller 12*a*. The operation of the heat source 12*c* is controlled to control the temperature of the fixing roller 12*a* so as to be maintained at a predetermined temperature. The fixing device 12 is configured to heat the fixing roller 12*a* to a predetermined fixing temperature by using the heat source 12*c* and then cause the recording material P on which unfixed images (specifically, the unfixed toner images) are formed to pass through a fixing nip part N so that the unfixed images (specifically, the unfixed toner images) are fixed to the recording material P as a result of heat and pressure applied at the fixing nip part N.

In the image forming apparatus 100 described above, image formation is performed as described below. First, the surfaces of the photoreceptors 2*a* to 2*d* are evenly charged by the respective charging devices 3*a* to 3*d*, and each of the evenly charged surfaces of the photoreceptors 2*a* to 2*d* is exposed, by the exposure device 4, to laser in accordance with the image data (image information). An electrostatic latent image is thereby formed on each of the photoreceptors 2*a* to 2*d*.

Next, in the image forming apparatus 100, the electrostatic latent images formed on the photoreceptors 2*a* to 2*d* are developed by the respective developing devices 5*a* to 5*d* to be visible as toner images. The visible toner images are transferred onto the intermediate transfer belt 7 by the first transfer devices 6*a* to 6*d* to which a bias voltage having a polarity opposite to the polarity of the toners Ta to Td is applied. The toner images are thereby formed on the intermediate transfer belt 7.

Next, in the image forming apparatus 100, the toner images formed on the intermediate transfer belt 7 are transported to the second transfer device 11 by the intermediate transfer belt 7 that is rotated in the predetermined rotation direction E. The recording material P pulled out from feeding rollers 13*a* of the sheet-feeding device 13 toward a transport path S and transported along the transport path S is transported by transport rollers 14 and resist rollers 15 to the second transfer device 11 in synchronization with the toner images on the intermediate transfer belt 7. The toner images transported to the second transfer device 11 are transferred by the second transfer device 11 onto the recording material P transported to the second transfer device 11.

Next, in the image forming apparatus 100, the toner images transferred on the recording material P are transported to the fixing device 12. When the toner images pass the fixing device 12, heat and pressure are applied to the toner images on the recording material P to fuse and fix the toner images to the recording material P. Then, the recording material P to which the toner images are fixed by the fixing device 12 is placed on a discharge tray 17 by being discharged, by discharge rollers 16, to the outside of the image forming apparatus body 1 to complete processes of the image formation.

The transport path S includes a reverse path Sr that guides, to the upstream of the resist rollers 15, the recording material P transported by the discharge rollers 16 in a reverse direction, so that the recording material P is reversed. When image formation is intended to be performed not only on a front surface of the recording material P but also on a back surface thereof in the image forming apparatus 100, the recording material P is reversed by being transported in the reverse direction from the discharge rollers 16 to the reverse path Sr and is re-guided to the resist rollers 15. Then, after toner images are formed on and fixed to the back surface of the recording material P in the same manner as for the front surface of the recording material P, the recording material P is placed on the discharge tray 17 by being discharged to the outside of the image forming apparatus body 1.

An electric power supply part 18 included in the image forming apparatus 100 illustrated in FIG. 1 will be described later.

Toner Storage Part

Figure 2:
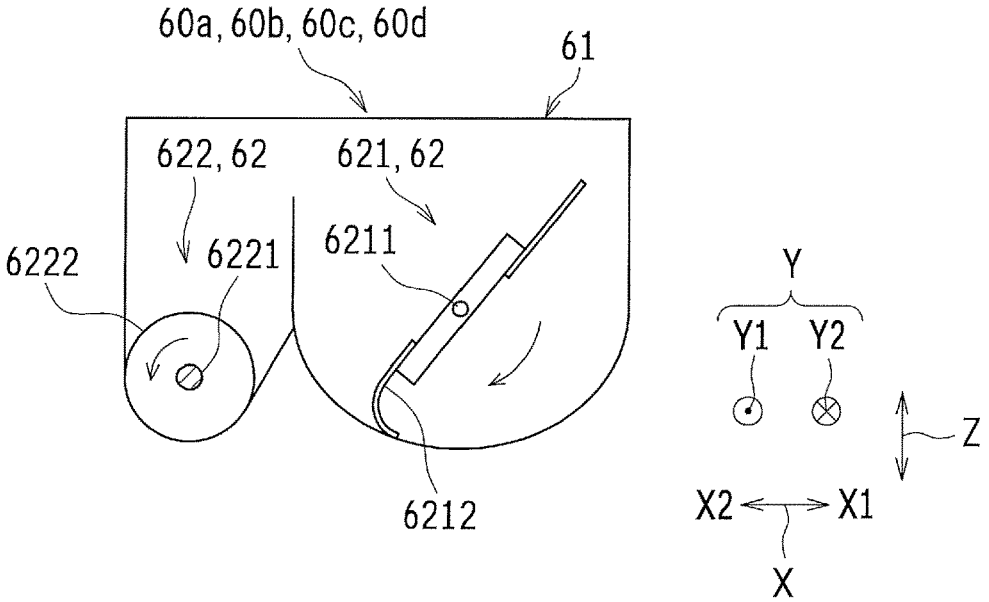
FIG. 2 is a schematic cross sectional view, from a rear side, illustrating a toner storage part illustrated in FIG. 1.
Figure 3:
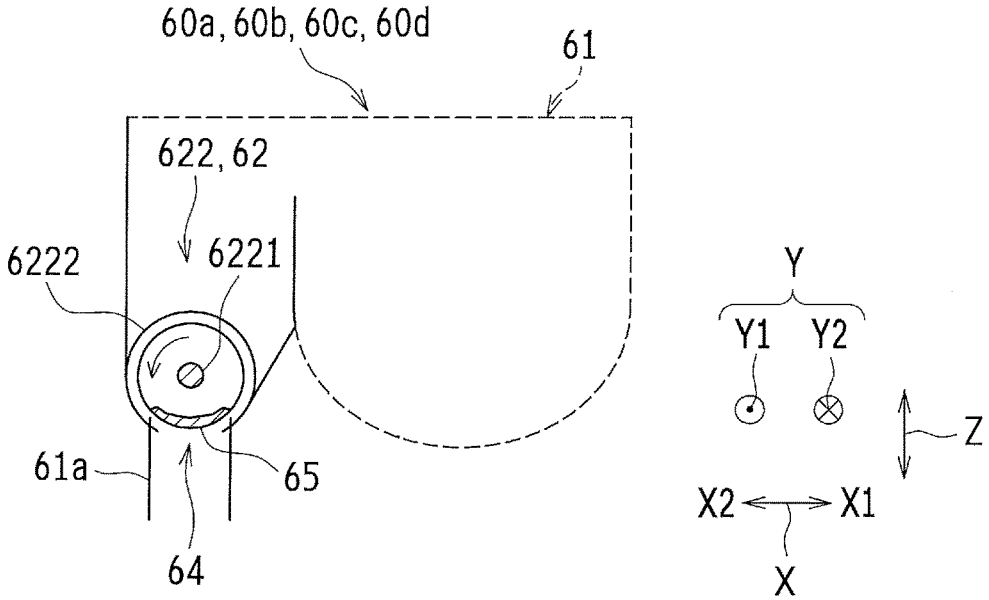
FIG. 3 is a schematic cross sectional view, from the rear side, illustrating a portion including a toner replenishing member of the toner storage part illustrated in FIG. 1.
Figure 4:
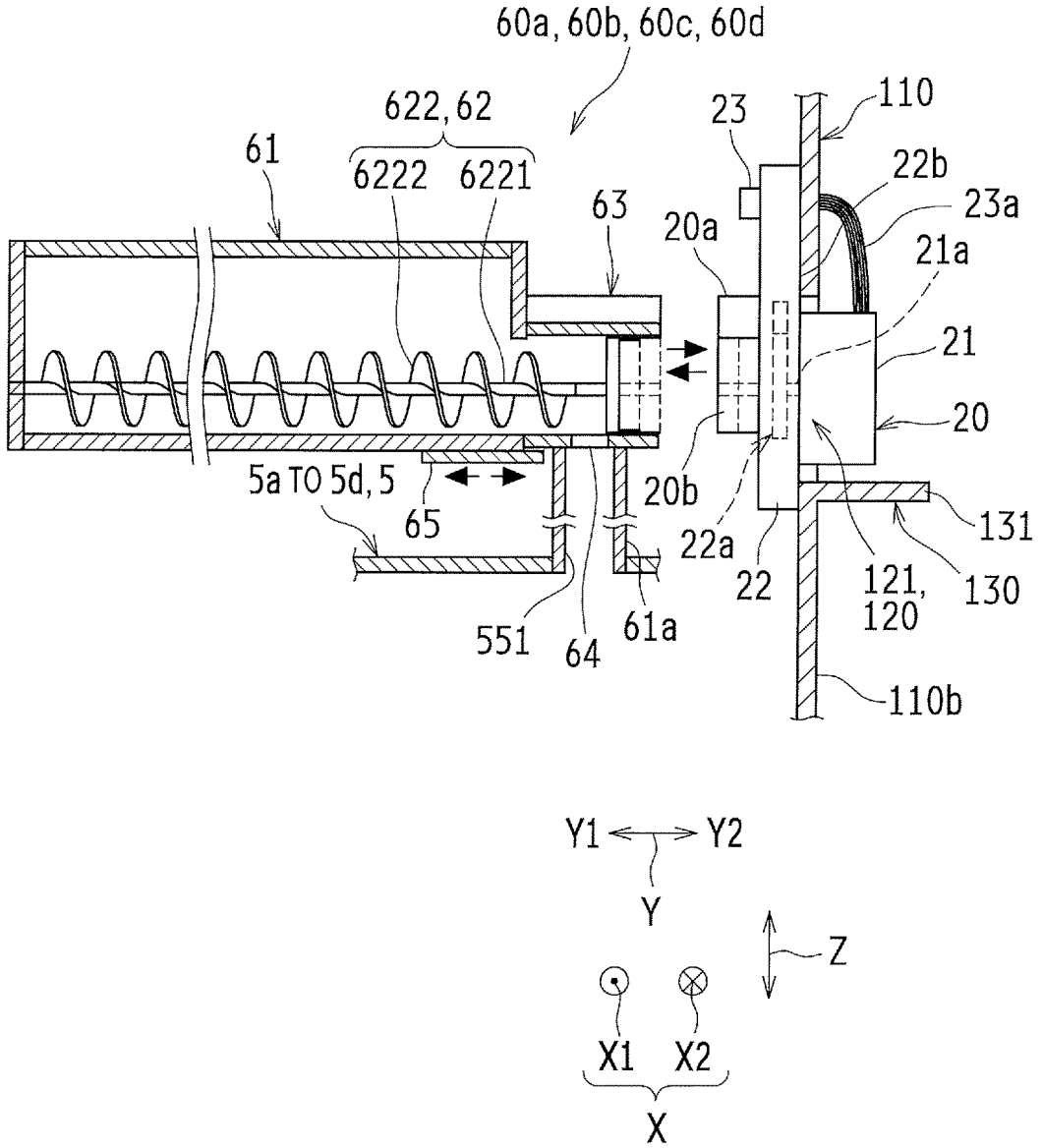
FIG. 4 is a schematic longitudinal sectional view of the toner storage part illustrated in FIG. 1.

FIG. 2 is a schematic cross sectional view, from the rear side Y2, illustrating the toner storage parts 60*a* to 60*d* illustrated in FIG. 1. FIG. 3 is a schematic cross sectional view, from the rear side Y2, illustrating a portion including a toner replenishing member 622 of the toner storage parts 60*a* to 60*d* illustrated in FIG. 2. FIG. 4 is a schematic longitudinal sectional view of the toner storage parts 60*a* to 60*d* illustrated in FIG. 1.

Note that the toner storage parts 60*a* to 60*d* illustrated in FIG. 1 have substantially identical configurations and are thus indicated by a single illustration in each of FIGS. 2 to 4. FIGS. 2 to 4 each illustrate a state in which the toner storage parts 60*a* to 60*d* do not store the respective toners Ta to Td.

As illustrated in FIGS. 2 to 4, each of the toner storage parts 60*a* to 60*d* constitutes a long box-shaped container (specifically, a resin container) that extends in the depth direction Y. The toner storage parts 60*a* to 60*d* store the respective toners Ta to Td for replenishment and supply the respective toners Ta to Td to the developing devices 5*a* to 5*d* corresponding thereto.

The toner storage parts 60*a* to 60*d* include respective toner storage containers 61 and respective toner supply members 62. The toner storage containers 61 store the toners Ta to Td corresponding thereto. The toner supply members 62 supply the respective toners Ta to Td stored in the toner storage containers 61 to the developing devices 5*a* to 5*d* corresponding thereto. In the present embodiment, each of the toner supply members 62 includes a toner stirring member 621 (refer to FIG. 2) and the toner replenishing member 622. The toner stirring members 621 stir the respective toners Ta to Td stored in the toner storage containers 61. The toner replenishing members 622 replenish the respective toners Ta to Td stirred by the toner stirring members 621 to the developing devices 5*a* to 5*d* corresponding thereto.

The toner storage parts 60*a* to 60*d* communicate with the developing devices 5*a* to 5*d* corresponding thereto via the respective toner supply ports 551 (refer to FIG. 4) of the cylindrical toner replenishing paths 61*a* (refer to FIG. 4) extending vertically from the respective developing devices 5*a* to 5*d*.

The image forming apparatus 100 includes a drive unit 20 (refer to FIG. 4) including a drive part 21 (in the present embodiment, an electric drive part (specifically, a drive motor) that uses electric power for driving) (refer to FIG. 4). The drive part 21 drives component members (in the present embodiment, the toner supply members 62 of the toner storage parts 60*a* to 60*d* (specifically, the toner stirring members 621 and the respective toner replenishing members 622)) of the image forming apparatus body 1.

Specifically, the drive unit 20 drives (rotationally drives in the present embodiment) the toner stirring members 621 and the toner replenishing members 622 of the toner supply members 62. The drive unit 20 is provided with, on an output side thereof, output shaft portions 20*a* and 20*b* (refer to FIG. 4) each having a structure that couples with the toner stirring member 621 and the toner replenishing member 622 corresponding thereto. Examples of the coupling structure include various types of structures. The present embodiment employs a fitting structure that includes a projection disposed on an output-side end surface of the drive unit 20 and a recess disposed on an output-side end surface of the toner supply member 62, the output-side end surfaces facing each other.

Each toner stirring member 621 includes a rotary shaft 6211 (refer to FIG. 2) axially supported in a longitudinal direction (the depth direction Y in the present embodiment) and a toner discharge member 6212 (refer to FIG. 2) that is disposed on the rotary shaft 6211. The toner discharge members 6212 stir and discharge the toners Ta to Td corresponding thereto. The rotary shafts 6211 rotate about respective axes to cause the toner stirring members 621 corresponding thereto to pump the respective toners Ta to Td stored in the toner storage containers 61 while stirring the toners Ta to Td by using the respective toner discharge members 6212 and to transport the toners Ta to Td to the respective toner replenishing members 622.

Each of the toner replenishing members 622 includes a rotary shaft 6221 axially supported in the longitudinal direction (the depth direction Y in the present embodiment) and a toner-transporting screw blade 6222 disposed, in a substantially spiral form, on an outer circumferential surface of the rotary shaft 6221. The rotary shaft 6221 and the screw blade 6222 of each toner replenishing member 622 constitute a screw auger.

A coupling portion 63 (refer to FIG. 4) is disposed on the rear side Y2 of the toner stirring member 621 and the toner replenishing member 622 of each toner storage container 61.

The coupling portions 63 engage and couple input sides (specifically, the rotary shafts 6211 and 6221) of the toner supply members 62 and output sides (specifically, the output shaft portions 20*a* and 20*b*) of the drive unit 20 with each other in a state in which the toner storage parts 60*a* to 60*d* are attached to the image forming apparatus body 1. Thus, the toner supply members 62 (specifically the toner stirring members 621 and the toner replenishing members 622) are enabled to be rotated by being rotationally driven by the drive part 21 of the drive unit 20. The toner replenishing ports 64 (refer to FIGS. 3 and 4) through which the toners Ta to Td are replenished are disposed at the bottom surfaces of the toner storage parts 60*a* to 60*d* (the coupling portions 63 in the present embodiment) on the toner replenishing member 622 side in the left-right direction X. The toner replenishing paths 61*a* are disposed at positions corresponding to the respective toner replenishing ports 64.

Responsive to the rotational driving of the drive part 21 of the drive unit 20, the toner storage parts 60*a* to 60*d* transport the toners Ta to Td to the toner replenishing members 622 while stirring the toners Ta to Td by rotating the toner stirring members 621. Then, the toner storage parts 60*a* to 60*d* transport the respective toners Ta to Td to the toner replenishing ports 64 by rotating the respective toner replenishing members 622. As a result, the toner storage parts 60*a* to 60*d* are enabled to perform replenishing by dropping the toners Ta to Td stored in the toner storage containers 61 into the developing devices 5*a* to 5*d* through the respective toner replenishing ports 64.

The toner storage parts 60*a* to 60*d* are provided with respective shutter mechanisms 65 (refer to FIGS. 3 and 4) that are supported (for example, fitted in slide grooves) on outer surfaces of the corresponding toner storage parts 60*a* to 60*d* so as to be capable of sliding in a longitudinal direction (the depth direction Y in the present embodiment). The shutter mechanisms 65 open and close the respective toner replenishing ports 64. The shutter mechanisms 65 may have a publicly known configuration, and detailed description thereof thus will be omitted. The shutter mechanisms 65 slide to open and close the toner replenishing ports 64 corresponding thereto by coming into contact with respective contact members (not shown) of the image forming apparatus body 1 in interlocking with insertion and extraction of the toner storage parts 60*a* to 60*d* corresponding thereto into and from the image forming apparatus body 1.

Hereinafter, a toner storage part 60 as a representative of the toner storage parts 60*a* to 60*d* and a developing device 5 as a representative of the developing devices 5*a* to 5*d* will be described.

Drive Unit

Figure 5:
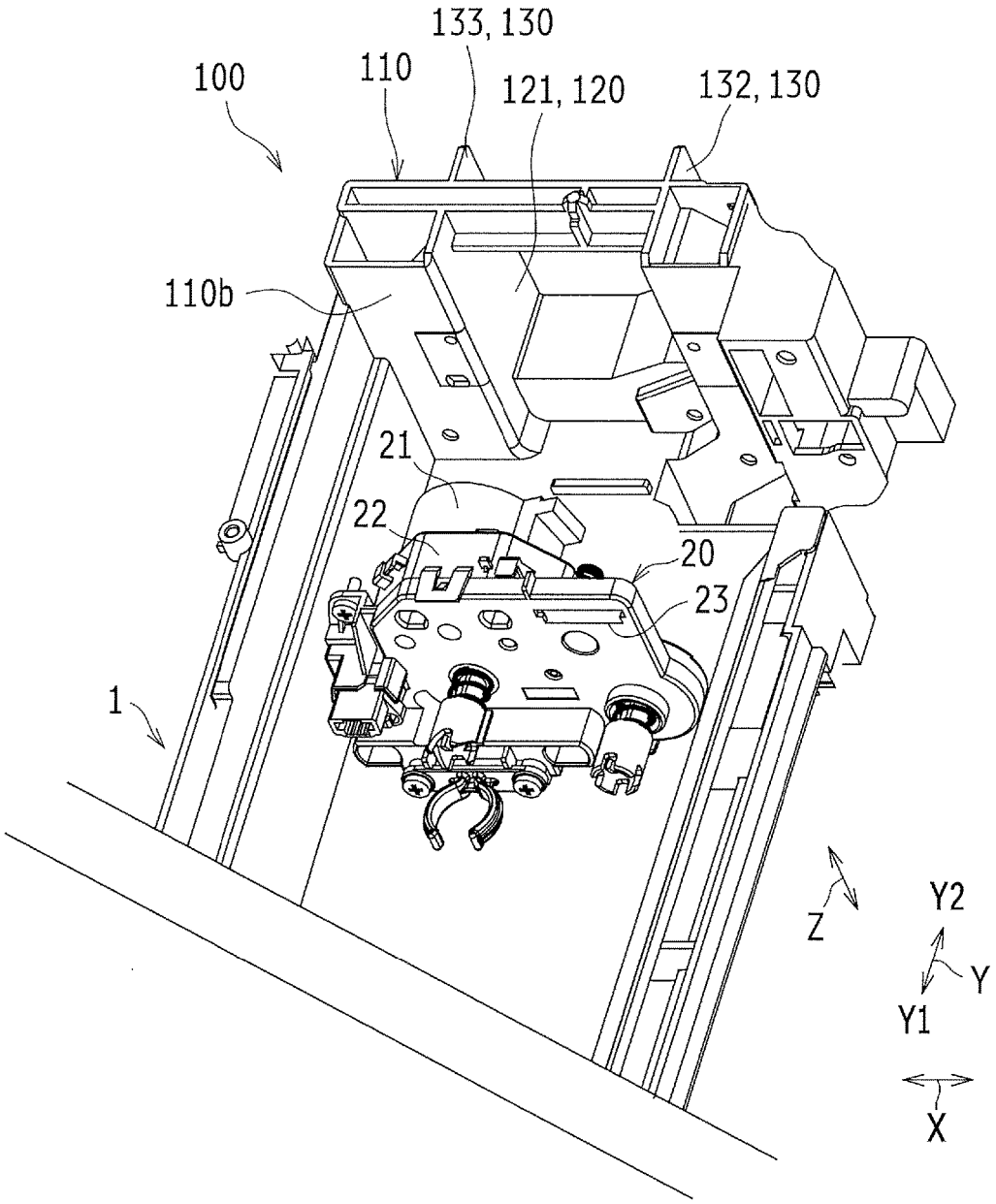
FIG. 5 is a schematic perspective view, obliquely from above and on a front side, illustrating a state in which a drive unit is to be disposed on an inner surface of a rear-side frame member in the image forming apparatus according to the present embodiment.
Figure 6:
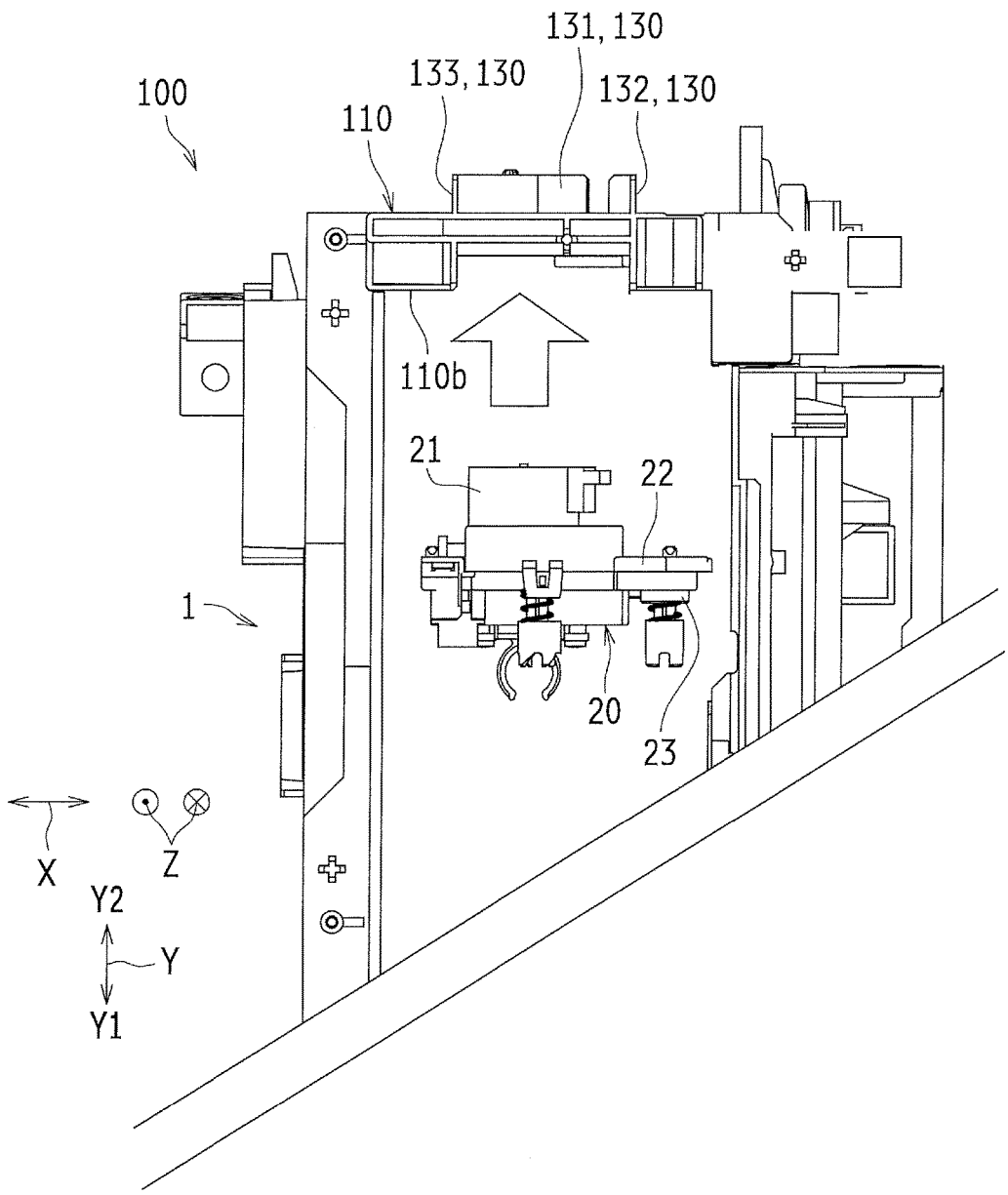
FIG. 6 is a schematic plan view illustrating a state of the drive unit illustrated in FIG. 5.
Figure 7:
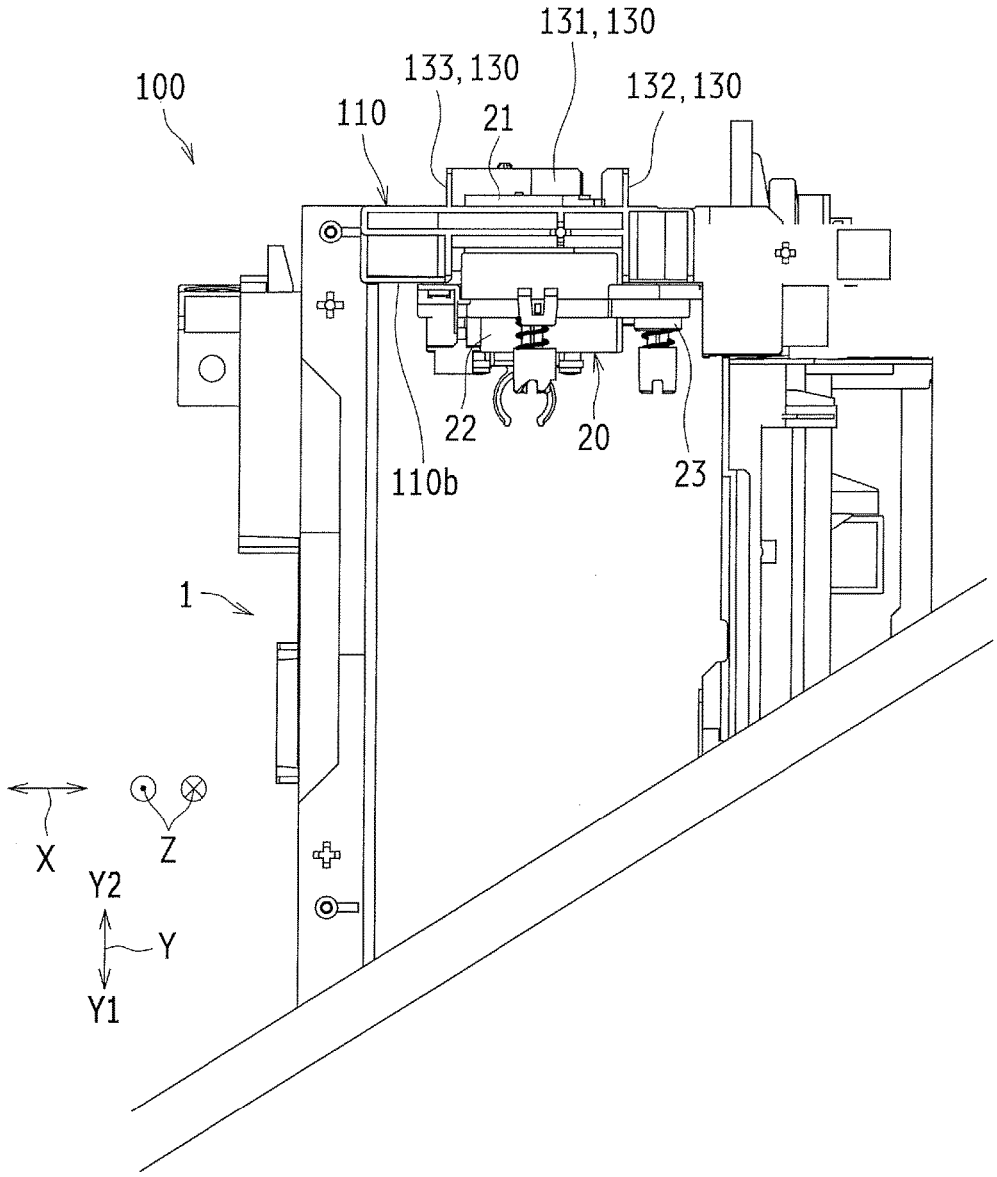
FIG. 7 is a schematic plan view illustrating a state in which the drive unit is disposed on the inner surface of the rear-side frame member in the image forming apparatus according to the present embodiment.

FIG. 5 is a schematic perspective view, obliquely from above and on the front side Y1, illustrating a state in which the drive unit 20 is to be disposed on an inner surface 110*b* of a rear-side frame member 110 of the image forming apparatus 100 according to the present embodiment. FIG. 6 is a schematic plan view illustrating a state of the drive unit 20 illustrated in FIG. 5. FIG. 7 is a schematic plan view illustrating a state in which the drive unit 20 is disposed on the inner surface 110*b* of the rear-side frame member 110 of the image forming apparatus 100 according to the present embodiment.

Figure 8:
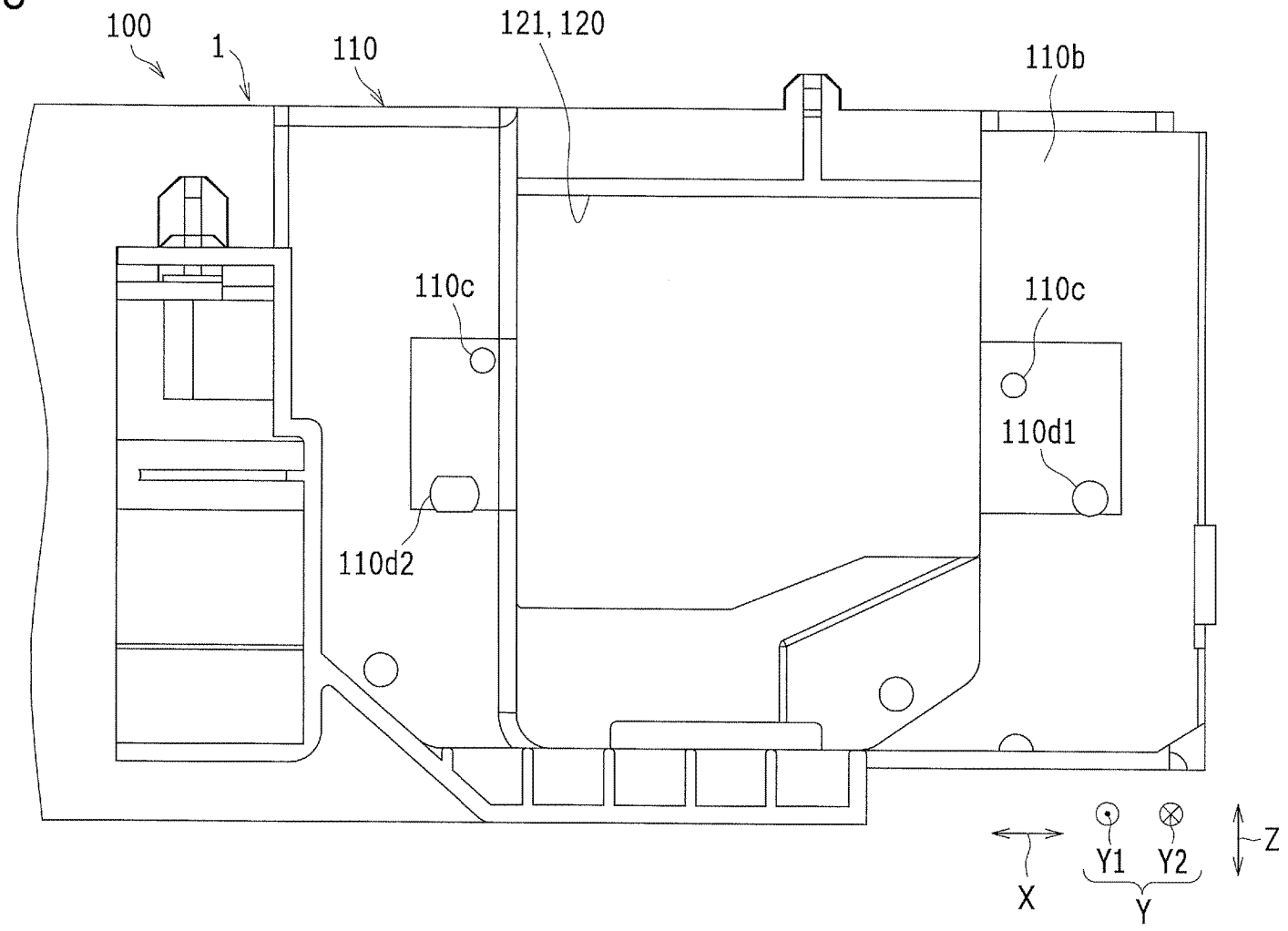
FIG. 8 is a schematic front view of the rear-side frame member illustrated in FIGS. 5 to 7.
Figure 9:
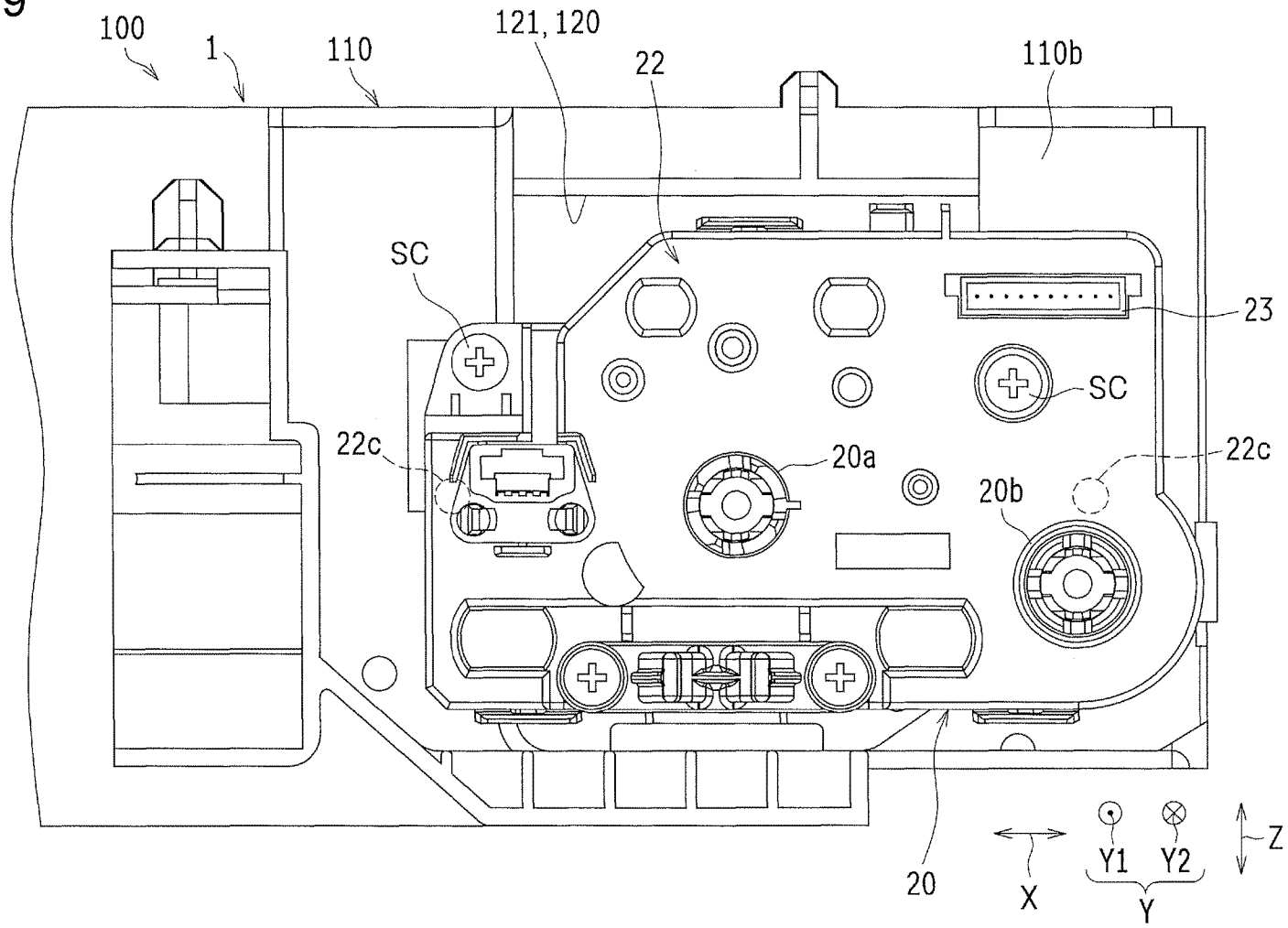
FIG. 9 is a schematic front view illustrating a state in which the drive unit illustrated in FIG. 7 is attached to the rear-side frame member.
Figure 10:
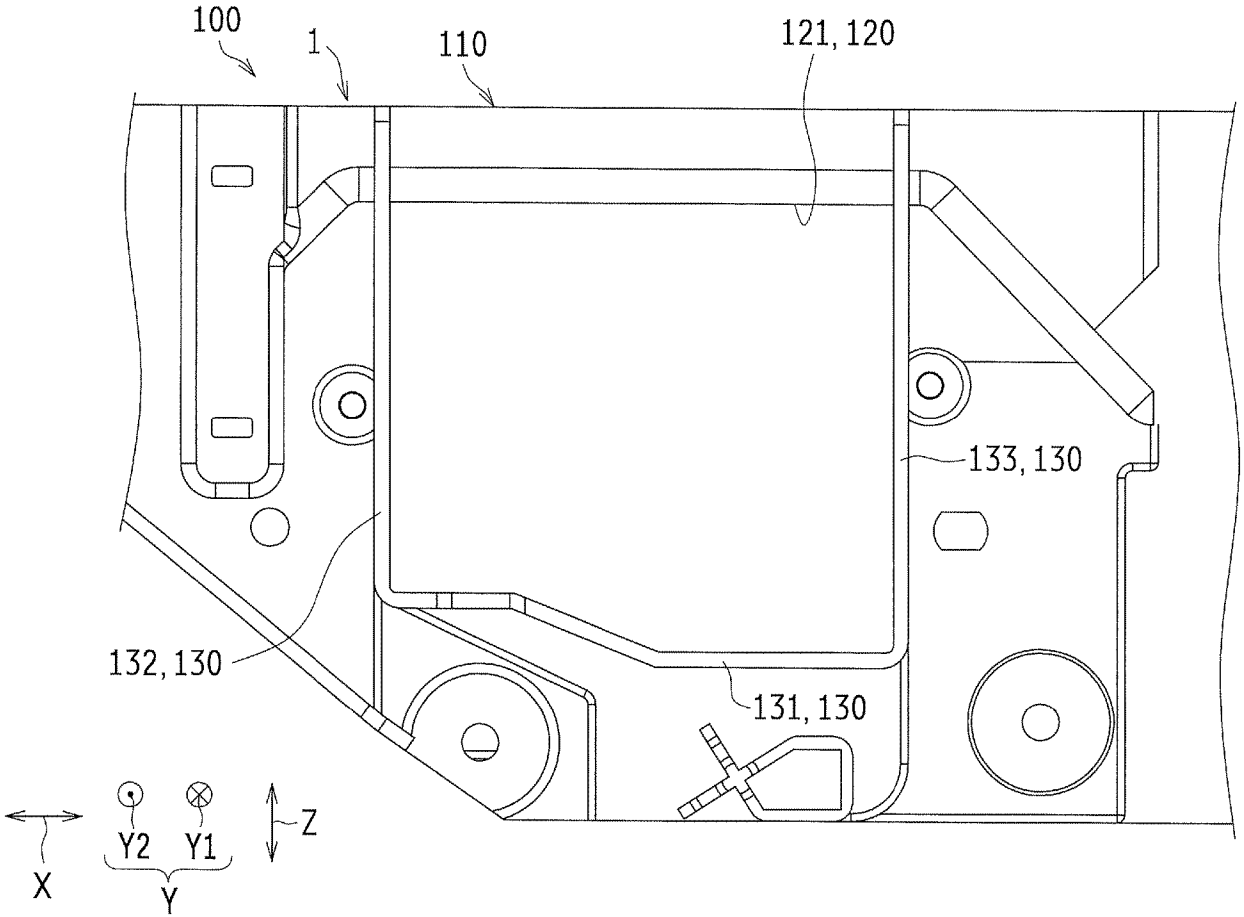
FIG. 10 is a schematic rear view of the rear-side frame member illustrated in FIGS. 5 to 7.
Figure 11:
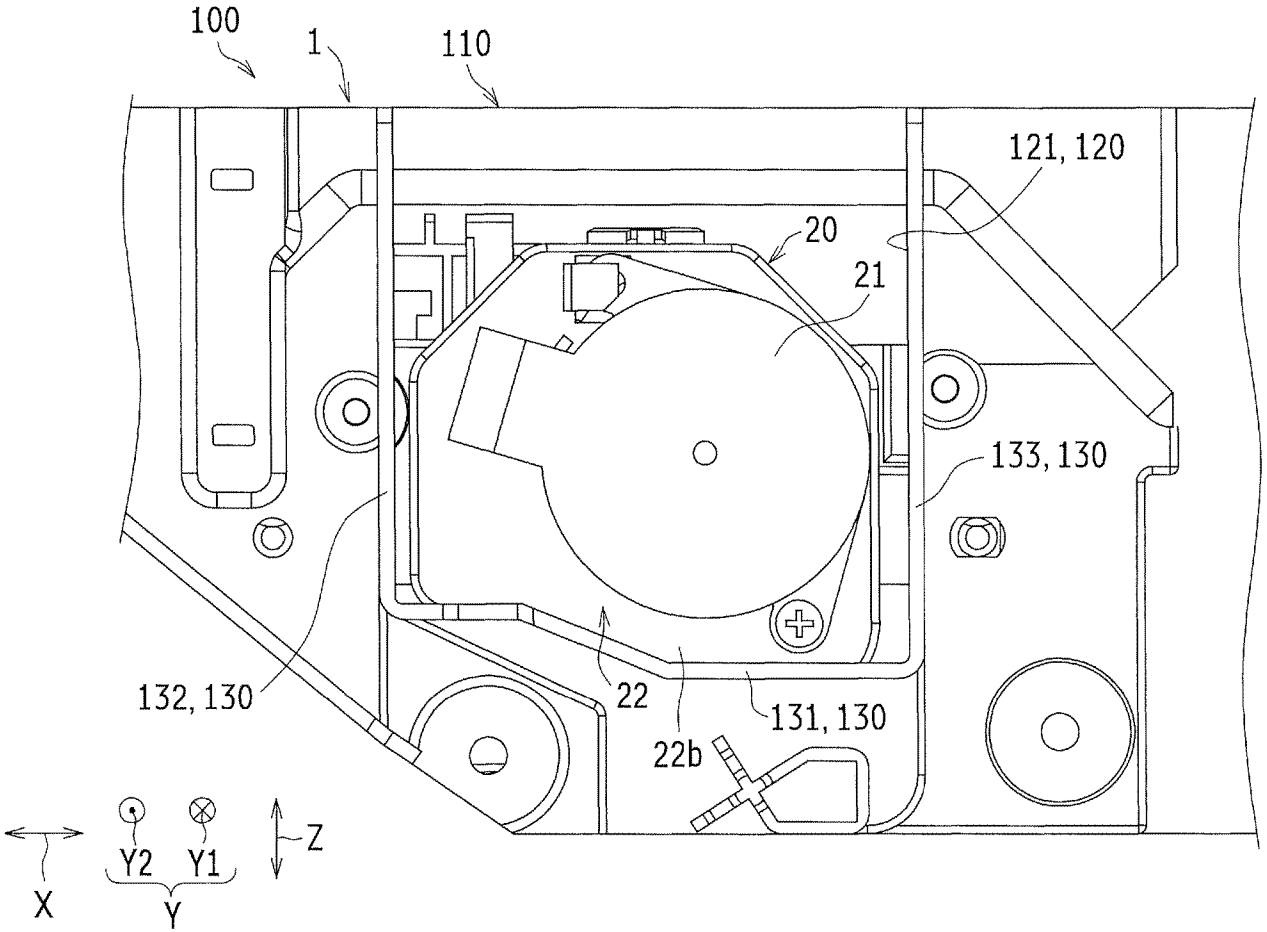
FIG. 11 is a schematic rear view illustrating the state in which the drive unit illustrated in FIG. 7 is attached to the rear-side frame member.

FIG. 8 is a schematic front view of the rear-side frame member 110 illustrated in FIGS. 5 to 7. FIG. 9 is a schematic front view illustrating a state in which the drive unit 20 illustrated in FIG. 7 is attached to the rear-side frame member 110. FIG. 10 is a schematic rear view of the rear-side frame member 110 illustrated in FIGS. 5 to 7. FIG. 11 is a schematic rear view illustrating the state in which the drive unit 20 illustrated in FIG. 7 is attached to the rear-side frame member 110.

Figure 12:
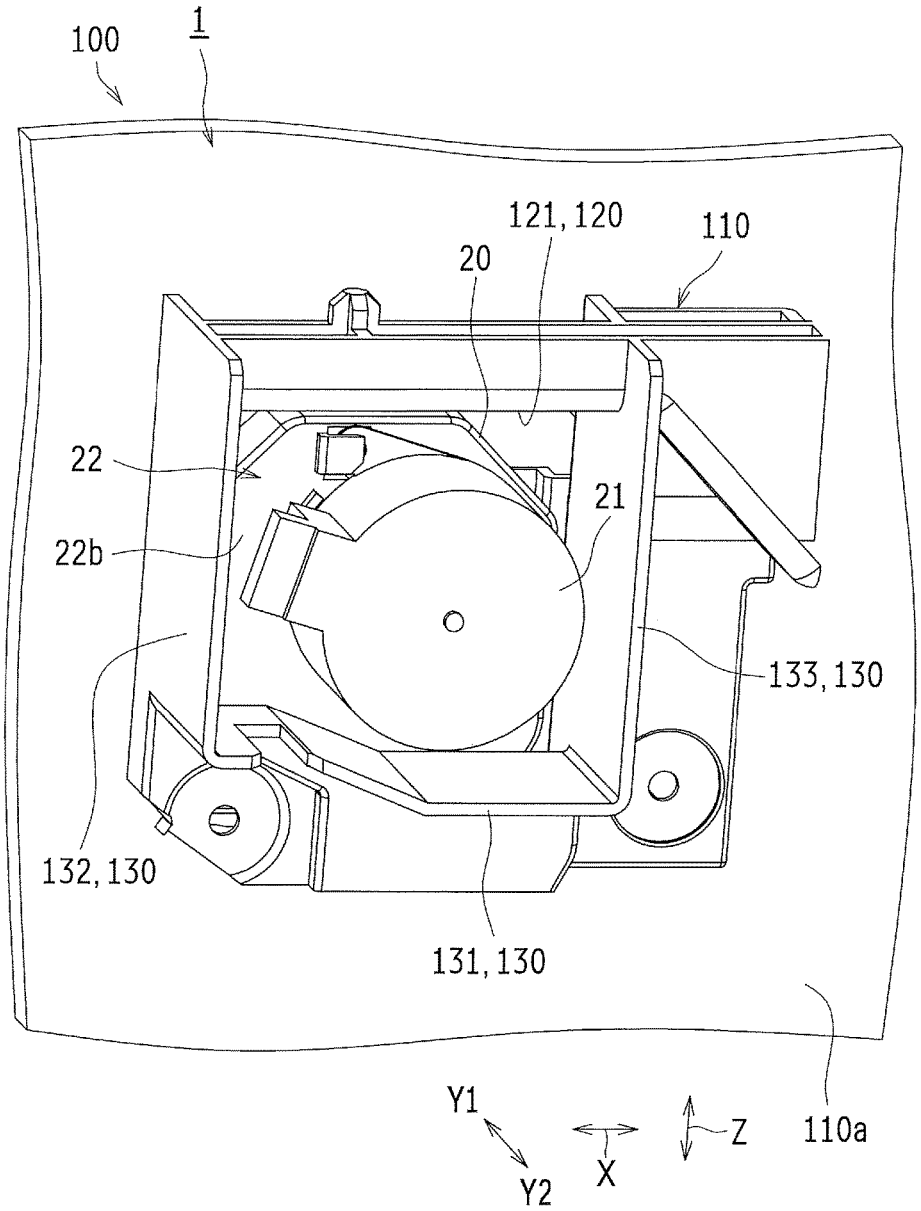
FIG. 12 is a schematic perspective view, obliquely from above and on the rear side, illustrating the state in which the drive unit illustrated in FIG. 7 is attached to the rear-side frame member.
Figure 13:
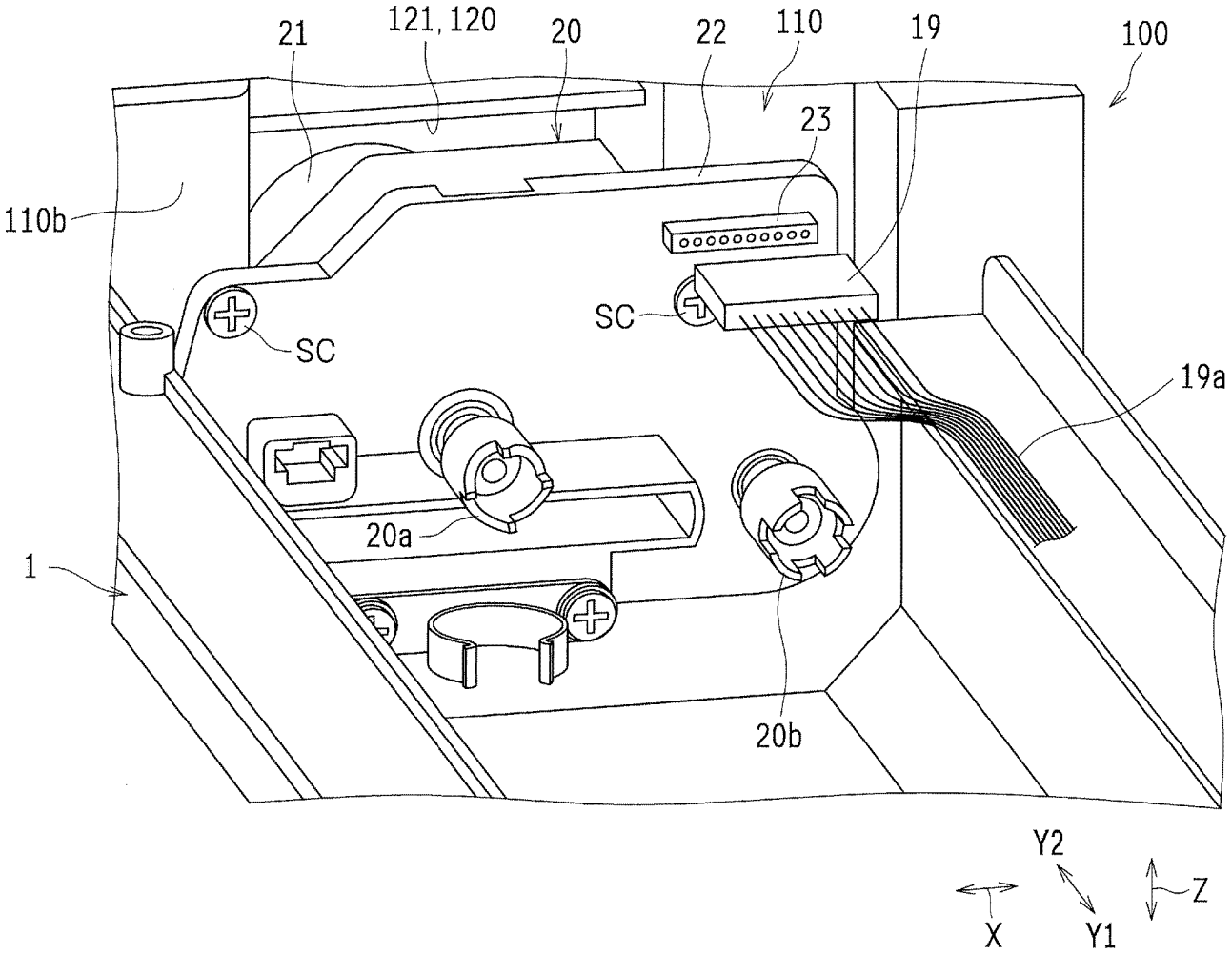
FIG. 13 is a schematic perspective view, obliquely from above and on the front side, illustrating the state in which the drive unit illustrated in FIG. 7 is attached to the rear-side frame member.

FIG. 12 is a schematic perspective view, obliquely from above and on the rear side Y2, illustrating the state in which the drive unit 20 illustrated in FIG. 7 is attached to the rear-side frame member 110. FIG. 13 is a schematic perspective view, obliquely from above and on the front side Y1, illustrating the state in which the drive unit 20 illustrated in FIG. 7 is attached to the rear-side frame member 110.

The image forming apparatus 100 according to the present embodiment includes the rear-side frame member 110 and the drive unit 20 (refer to FIGS. 5 to 7, 9, and 11 to 13). The rear-side frame member 110 is disposed on the rear side Y2 of the image forming apparatus body 1 so as to extend in or substantially in a vertical direction Z. The drive unit 20 includes the drive part 21 (refer to FIGS. 5 to 7 and 11 to 13). The drive part 21 drives the component members (in the present embodiment, the toner supply member 62 of the toner storage part 60 (specifically, the toner stirring member 621 and the toner replenishing member 622)) of the image forming apparatus body 1.

The drive unit 20 is detachably disposed on the inner (front side Y1) surface 110*b* (refer to FIGS. 4 to 9 and 13) of the rear-side frame member 110 such that the drive part 21 faces outward from the image forming apparatus body 1.

The image forming apparatus 100 according to the present embodiment enables maintenance work, such as cleaning and replacement, of the drive unit 20 to be performed from the front side Y1 of the image forming apparatus body 1, because the drive part 21 of the drive unit 20 is detachably disposed on the inner surface 110*b* of the rear-side frame member 110. Thus, it is possible to easily perform the maintenance work of the drive unit 20, which improves maintainability of the drive unit 20.

Moreover, because the drive unit 20 is disposed on the inner surface 110*b* of the rear-side frame member 110 such that the drive part 21 faces outward from the image forming apparatus body 1, it is possible to separate the drive part 21 of the drive unit 20 from the component members (component members for image formation, for example, the photoreceptors 2*a*, 2*b*, 2*c*, and 2*d* and the charging devices 3*a*, 3*b*, 3*c*, and 3*d*) disposed in the image forming apparatus body 1. In the present embodiment, the drive part 21 is separated from the component members by a separation member such as a support member 22 (specifically, a drive unit body) on which the drive part 21 is disposed (refer to FIGS. 4 to 7, 9, and 11 to 13). Thus, it is possible to avoid interference (specifically, contact), with the drive part 21 of the drive unit 20, of the component members (for example, the component members for image formation, such as the photoreceptors 2*a*, 2*b*, 2*c*, and 2*d* and the charging devices 3*a*, 3*b*, 3*c*, and 3*d*) disposed in the image forming apparatus body 1. For example, it is possible for the component members disposed in the image forming apparatus body to avoid an influence of heat generated at the drive part.

Specifically, the drive unit 20 includes the drive part 21 and the support member 22 that supports the drive part 21. In the present embodiment, the support member 22 includes a drive transmission mechanism 22*a* (refer to FIG. 4) that transmits a rotational drive force from the drive part 21 to the component members (in the present embodiment, the toner supply member 62 of the toner storage part 60 (specifically, the toner stirring member 621 and the toner replenishing member 622)) of the image forming apparatus body 1. The drive transmission mechanism 22*a* (specifically, gear train) is configured to rotate the toner stirring member 621 and the toner replenishing member 622 in directions opposite to each other.

The input side (specifically, the side of the drive unit 20 connected to a rotary shaft 21*a* refer to FIG. 4) of the drive part 21) of the drive transmission mechanism 22*a* of the support member 22 is positioned on the rear side Y2. The output side (specifically, the side connected to the rotary shaft 6211 of the toner stirring member 621 and the rotary shaft 6221 of the toner replenishing member 622) of the drive transmission mechanism 22*a* of the support member 22 is positioned on the front side Y1. The input side of the drive transmission mechanism 22*a* is connected, on the rear side Y2, to the drive part 21 (specifically, the rotary shaft 21*a*) of the drive unit 20. In other words, the drive part 21 of the drive unit 20 is secured to an outer (rear side Y2) surface 22*b* (refer to FIGS. 4, 11, and 12) of the support member 22. The body side (specifically, the side opposite the rotary shaft 21*a*) of the drive part 21 is positioned on the rear side Y2.

The support member 22 is detachably secured to the rear-side frame member 110 such that the outer (rear side Y2) surface 22*b* faces (specifically, in contact with) the inner surface 110*b* of the rear-side frame member 110, by one or a plurality of securing members SC (in the present embodiment, two screws (refer to FIGS. 9 and 13)) that are coupled to respective portions to be secured (in the present embodiment, two female screw holes 110*c* (refer to FIG. 8)).

The output side of the drive transmission mechanism 22*a* of the drive unit 20 is connected, on the front side Y1, to the output side (specifically, the rotary shafts 6211 and 6221) of the toner supply member 62.

First Embodiment

Incidentally, due to the drive unit 20 that is detachably disposed on the inner surface 110*b* of the rear-side frame member 110 such that the drive part 21 faces outward from the image forming apparatus body 1, the rear-side frame member 110 may interfere with the drive part 21 of the drive unit 20. In order to avoid interference of the rear-side frame member 110 with the drive part 21 of the drive unit 20, a gap may be provided between the rear-side frame member 110 and the drive part 21; however, in this case, the gap increases, in the image forming apparatus body 1, a space having a size corresponding to the size of the gap.

Thus, it is desirable to suppress the interference of the rear-side frame member 110 with the drive part 21 of the drive unit 20 while achieving space-saving in the image forming apparatus body 1.

In this respect, in the image forming apparatus 100 according to a first embodiment, the rear-side frame member 110 may be provided with an avoiding portion 120 (FIGS. 4, 5, and 8 to 13) that avoids the interference of the rear-side frame member 110 with the drive part 21 of the drive unit 20.

As a result, it is possible, due to the avoiding portion 120 of the rear-side frame member 110, to suppress the interference of the rear-side frame member 110 with the drive part 21 of the drive unit 20. Moreover, because a gap for avoiding the interference of the rear-side frame member 110 with the drive part 21 of the drive unit is not provided due to the provision of the avoiding portion 120, it is possible to achieve space-saving in the image forming apparatus body 1 by a degree corresponding to the size of the gap.

Second Embodiment

In the image forming apparatus 100 according to a second embodiment, the avoiding portion 120 may be a through hole 121 (refer to FIGS. 4, 5, and 8 to 13) through which the drive part 21 of the drive unit 20 passes.

As a result, it is possible to dispose the drive part 21 of the drive unit 20 in the through hole 121 of the rear-side frame member 110 in a non-contact manner. Thus, it is possible to effectively suppress the interference of the rear-side frame member 110 with the drive part 21 of the drive unit 20. Moreover, because the through hole 121 enables the omission of a gap for avoiding the interference of the rear-side frame member 110 with the drive part 21 of the drive unit 20, it is possible to achieve space-saving in the image forming apparatus body 1 by a degree corresponding to the size of the cap.

Specifically, non-limiting examples of the shape of the through hole 121 include a circular shape, an oval shape, and a polygonal shape. In the second embodiment, the through hole 121 has a substantially quadrangular shape.

Third Embodiment

Incidentally, other component members (for example, electric components, substrates, and wires for connecting these component members to each other) disposed on the rear-side frame member 110 (in particular, an outer (rear side Y2) surface 110*a* (refer to FIG. 12) of the rear-side frame member 110) sometimes interferes with the drive part 21 of the drive unit 20.

Thus, it is desirable to avoid the interference of the other component members disposed on the rear-side frame member 110 with the drive part 21 of the drive unit 20.

In this respect, in the image forming apparatus 100 according to a third embodiment, a surrounding portion 130 (refer to FIGS. 4 to 7 and 10 to 12) that surrounds (specifically, surrounds in a non-contact manner) at least a portion of the circumference (in the third embodiment, the circumference excluding an upper portion thereof) of the drive part 21 of the drive unit 20 may be formed on the rear-side frame member 110 (in the third embodiment, the outer surface 110*a* of the rear-side frame member 110).

As a result, it is possible to protect, by using the surrounding portion 130 of the rear-side frame member 110, the drive part 21 of the drive unit 20 from the component members around the drive part 21. Thus, it is possible to avoid the interference of the other component members (for example, the electric components, the substrates, and the wires that connect these component members to each other) disposed on the rear-side frame member 110 (in the third embodiment, the outer surface 110*a* of the rear-side frame member 110) with the drive part 21 of the drive unit 20.

Specifically, the surrounding portion 130 may have a shape that is substantially polygonal cylindrical, substantially circular cylindrical, or substantially oval cylindrical with at least a portion in a circumferential direction thereof notched when viewed from the rear side Y2. When a portion in the circumferential direction of the surrounding portion 130 is notched, the position of the portion to be notched may be at a position where the other component members are not disposed. Specifically, if the shape of the surrounding portion 130 is quadrangular, the surrounding portion 130 may include at least one of an upper plate, a lower plate, a right plate, and a left plate when viewed from the front side Y1.

In the third embodiment, the surrounding portion 130 includes a lower plate 131 (refer to FIGS. 4, 6, 7, and 10 to 12), a right plate 132 (refer to FIGS. 5 to 7 and 10 to 12), and a left plate 133 (refer to FIGS. 5 to 7 and 10 to 12).

At least a part (for example, at least one of the plates) of the surrounding portion 130 may include one or a plurality of portions bent in a direction perpendicular to the depth direction Y. In the third embodiment, the lower plate 131 of the surrounding portion 130 includes two portions bent in the vertical direction Z. Specifically, the lower plate 131 includes two horizontal portions and an inclined portion formed between the horizontal portions.

The rear-side frame member 110 and the surrounding portion 130 are integral with each other. In the third embodiment, the lower plate 131, the right plate 132, and the left plate 133 of the surrounding portion 130 are integral with each other.

In the third embodiment, the surrounding portion 130 is disposed on the outer surface 110*a* of the rear-side frame member 110; however, the surrounding portion 130 may be disposed on the inner surface 110*b* of the rear-side frame member 110.

Moreover, the shape of the whole circumference of the surrounding portion 130 may be substantially polygonal cylindrical, substantially circular cylindrical, or substantially oval cylindrical. In addition, an opening on the rear side Y2 in the surrounding portion 130 may be closed. Specifically, a back surface plate that extends in both the left-right direction X and the vertical direction Z may be disposed on end surfaces on the rear side Y2 of the lower plate 131, the right plate 132, and the left plate 133 so that the drive part 21 is covered by the lower plate 131, the right plate 132, the left plate 133, and the back surface plate. The lower plate 131, the right plate 132, the left plate 133, and the back surface plate may be integral with each other.

In addition, the surrounding portion 130 may be disposed on the drive unit 20 (specifically, the support member 22).

The drive unit 20 may be positioned by recess-projection engagement at the rear-side frame member 110. Specifically, one (the rear-side frame member 110 in the third embodiment) of the drive unit 20 and the rear-side frame member 110 may be provided with one or a plurality of (two in the third embodiment) recessed portions 110*d*1 and 110*d*2 (refer to FIG. 8) (through holes in the third embodiment). The other one (the support member 22 of the drive unit 20 in the third embodiment) of the drive unit 20 and the rear-side frame member 110 may be provided with projecting portions 22*c* and 22*c* (refer to FIG. 9) (positioning pins in the third embodiment) that correspond to the recessed portions 110*d*1 and 110*d*2, respectively. One (in the third embodiment, the recessed portion 110*d*2 on the left side when viewed from the front side) of the recessed portions 110*d*1 and 110*d*2 is an elongated hole extending in the left-right direction X.

Fourth Embodiment

In the image forming apparatus 100 according to a fourth embodiment, the avoiding portion 120 may be a recessed portion (not illustrated) that covers the drive part 21 of the drive unit 20.

As a result, it is possible to dispose the drive part 21 of the drive unit 20 in the recessed portion of the rear-side frame member 110 in a non-contact manner. Thus, it is possible to effectively suppress the interference of the rear-side frame member 110 with the drive part 21 of the drive unit 20. Moreover, because the recessed portion enables the omission of a gap for avoiding the interference of the rear-side frame member 110 with the drive part 21 of the drive unit 20, it is possible to achieve space-saving in the image forming apparatus body 1 by a degree corresponding to the size of the gap.

Specifically, non-limiting examples of the recessed portion include a bottomed quadrangular cylindrical recessed portion, a bottomed circular cylindrical recessed portion, a bottomed oval cylindrical recessed portion, a circular arc-shaped recessed portion, a frustoconical recessed portion, and a truncated pyramid-shaped recessed portion. The recessed portion may have a through hole formed in a bottom surface (a top surface when viewed from the rear side Y2) thereof.

Fifth Embodiment

In the image forming apparatus 100 according to a fifth embodiment, the drive part 21 of the drive unit 20 may be an electric drive part. A connector 23 (refer to FIGS. 4 to 7, 9, and 13) electrically connected to the drive part 21 may be disposed on the drive unit 20 (the support member 22 in the fifth embodiment) such that a connected side thereof faces the front side Y1 of the image forming apparatus body 1. The drive part 21 may be electrically connected to the image forming apparatus body 1 via the connector 23. The drive part 21 electrically drives component members (in the fifth embodiment, the toner supply member 62 of the toner storage part 60 (specifically, the toner stirring member 621 and the toner replenishing member 622)).

As a result, it is possible to attach and detach the drive part 21, which is the electric drive part, to and from the connector 23 easily from the front side Y1 of the image forming apparatus body 1. Thus, it is possible to improve the efficiency of attaching and detaching the drive part 21 to and from the connector 23. Moreover, it is possible to attach and detach the drive part 21 to and from the connector 23 when attaching or detaching the drive unit 20 to or from the rear-side frame member 110 from the front side Y1 of the image forming apparatus body 1. Thus, it is possible to improve the efficiency of attaching and detaching the drive part 21 to and from the connector 23.

Specifically, the image forming apparatus body 1 may include the electric power supply part 18 (specifically, a drive circuit board) (refer to FIG. 1) that supplies electric power to the drive part 21 of the drive unit 20. A connector 19 (refer to FIG. 13) may be electrically connected to the output side of the electric power supply part 18. The connector 19 extending from the electric power supply part 18 via wires 19*a* (refer to FIG. 13) is disposed in the vicinity of the connector 23 of the drive part 21 on the front side Y1 of the drive unit 20.

In the fifth embodiment, the connector 23 of the drive part 21 of the drive unit 20 is positioned (refer to FIGS. 4, 9, and 13) above the output shaft portions 20*a* and 20*b* each having the structure that couples with the toner supply member 62 (specifically, the toner stirring member 621 and the toner replenishing member 622).

As a result, it is possible to effectively suppress the interference of the connector 23 and/or wires 23*a* (refer to FIG. 4) of the connector 23 with the output shaft portions 20*a* and 20*b* and the interference of the connector 19 and/or the wires 19*a* of the connector 19 with the toner storage part 60. Moreover, it is possible to more easily attach and detach the drive part 21 to and from the connector 23.

In the fifth embodiment, the toner replenishing port 64 and the toner supply port 551 are disposed on the rear side Y2 of the toner storage part 60 and the developing device 5, respectively. In this case, a toner from the toner replenishing port 64 and/or the toner supply port 551 sometimes causes a toner stain on the rear side Y2. As a result, the toner sometimes causes contact failure between the connector 23 and the connector 19. Thus, the toner replenishing port 64 and the toner supply port 551 may be disposed on the front side Y1 of the toner storage part 60 and the developing device 5, respectively. As a result, it is possible to avoid a toner stain caused, on the rear side Y2, by the toner from the toner replenishing port 64 and/or the toner supply port 551, which makes it possible to avoid contact failure caused between the connector 23 and the connector 19 by the toner.

Moreover, the toner replenishing port 64 and the toner supply port 551 disposed on the rear side Y2 of the toner storage part 60 and the developing device 5, respectively, may be disposed such that the connector 23 and the connector 19 do not overlap (specifically, deviated in the left-right direction X and/or the depth direction Y from) the toner replenishing port 64 and the toner supply port 551 in the vertical direction Z. For example, the connector 23 may be disposed on toe right side X1 of the drive unit 20 while the toner replenishing port 64 is disposed on the left side X2 of the toner storage part 60. As a result, even when the toner from the toner replenishing port 64 and/or the toner supply port 551 causes a toner stain on the rear side Y2, it is possible to avoid the contact failure caused by the toner, between the connector 23 (in particular, the connector 23 disposed below the toner replenishing port 64) and the connector 19.

Sixth Embodiment

Incidentally, in the first to fifth embodiments, the securing members SC such as screws are used to detachably attach) the drive unit 20 to the rear-side frame member 110. In this case, a tool is used to attach and detach the securing members SC, which increases the complexity of attaching and detaching the drive unit 20 to and from the rear-side frame member 110.

Therefore, it is desirable to improve the efficiency of attaching and detaching the drive unit 20 to and from the rear-side frame member 110.

In this respect, in each of a sixth embodiment and seventh to eleventh embodiments (described later), the drive unit 20 in the first to fifth embodiments is detachably disposed on the rear-side frame member 110.

Figure 14:
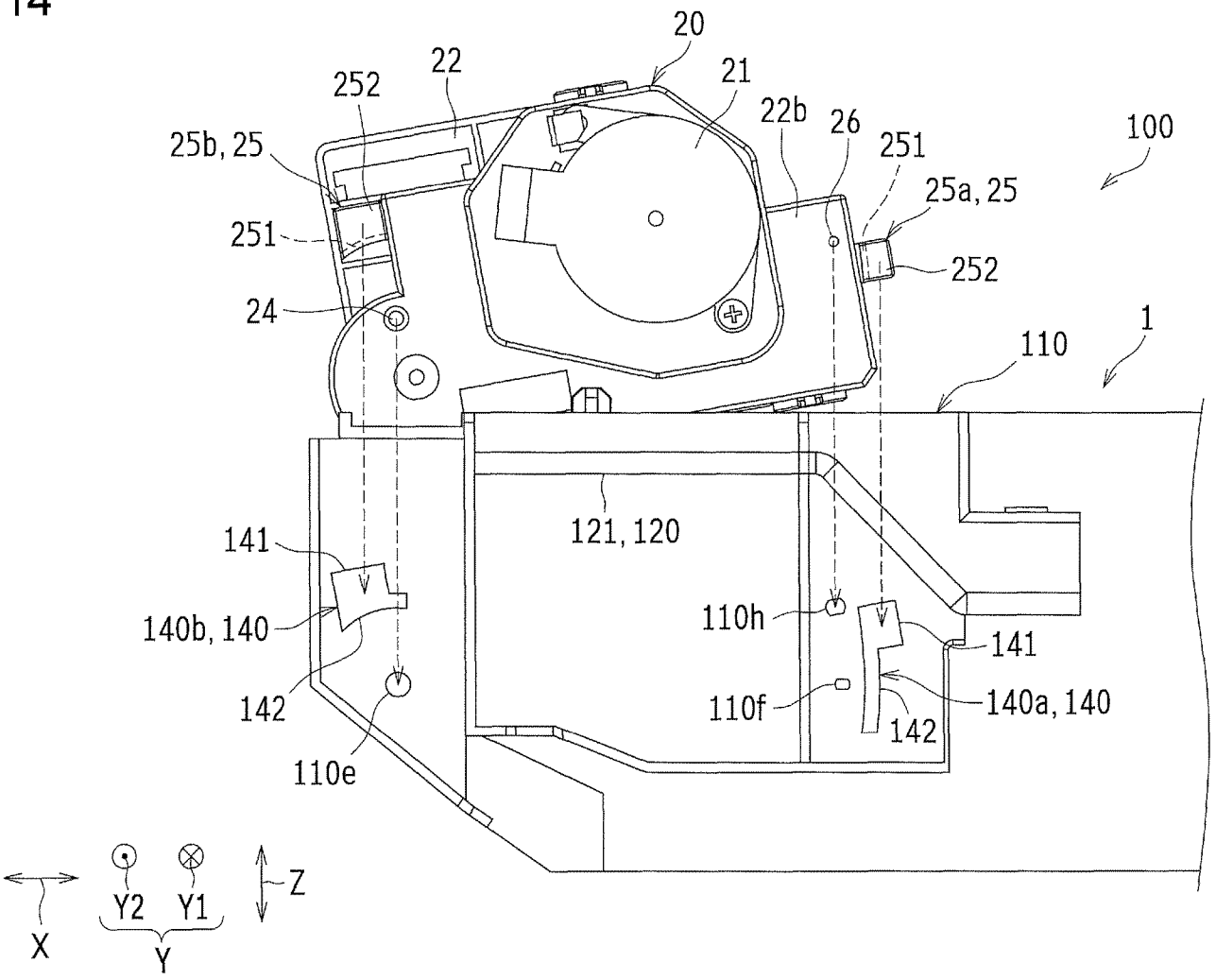
FIG. 14 is a schematic rear view illustrating, for describing a configuration in which the drive unit is detachably disposed on the rear-side frame member, a state in which the drive unit is not yet attached to the rear-side frame member.
Figure 15:
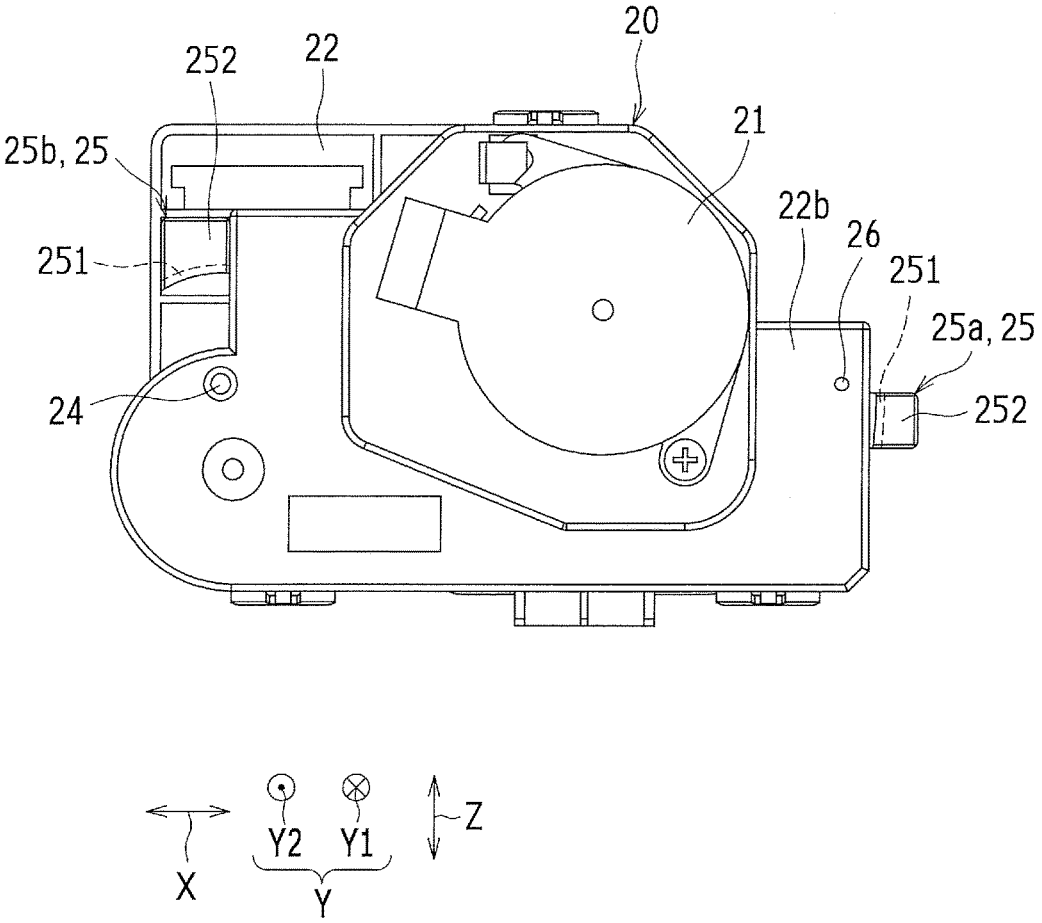
FIG. 15 is a schematic rear view of the drive unit illustrated in FIG. 14.
Figure 16:
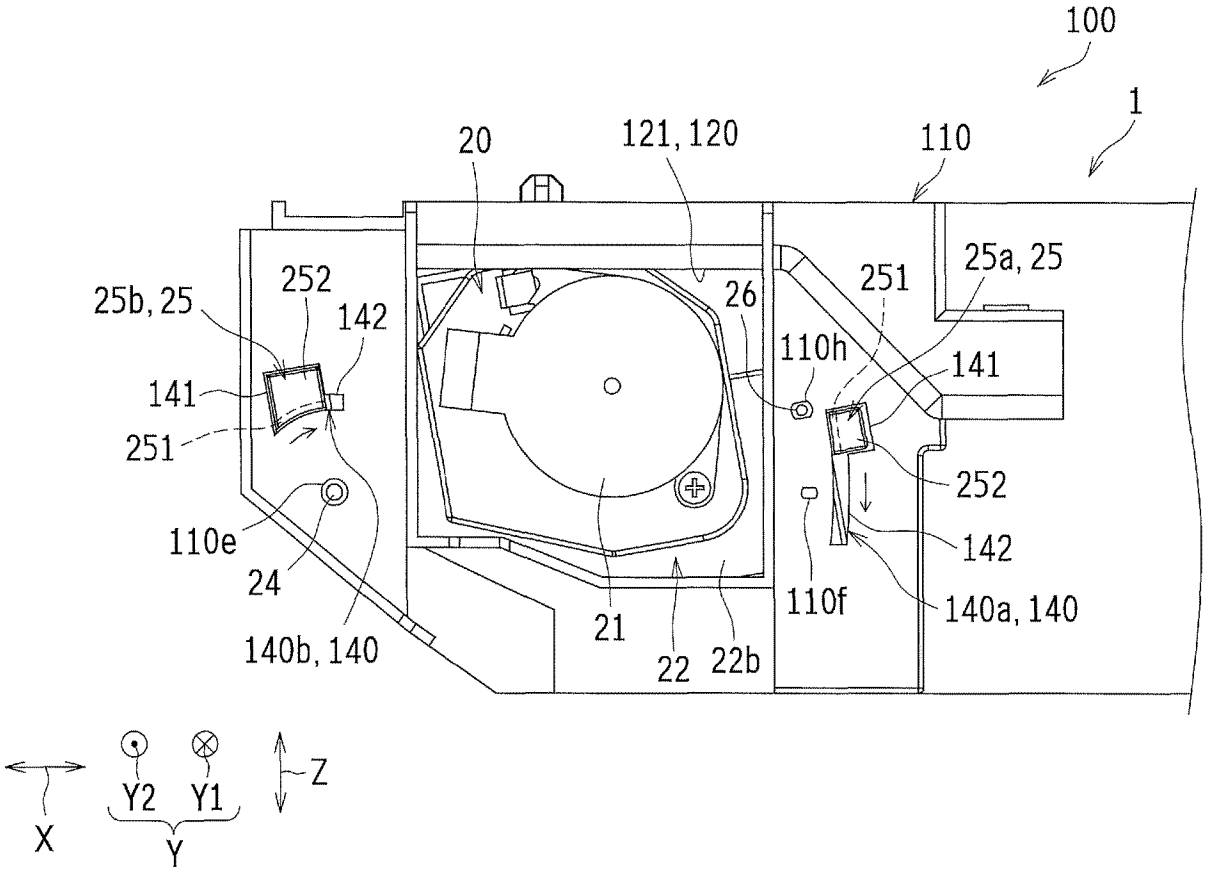
FIG. 16 is a schematic rear view illustrating a state in which the drive unit illustrated in FIG. 14 is attached to the rear-side frame member but not yet secured to the rear-side frame member by a pawl portion.

FIG. 14 is a schematic rear view illustrating, for describing a configuration in which the drive unit 20 is detachably disposed on the rear-side frame member 110, a state in which the drive unit 20 is not yet attached to the rear-side frame member 110. FIG. 15 is a schematic rear view of the drive unit 20 illustrated in FIG. 14. FIG. 16 is a schematic rear view illustrating a state in which the drive unit 20 illustrated in FIG. 14 is attached to the rear-side frame member 110 but not yet secured to the rear-side frame member 110 by a pawl portion 25.

Figure 17:
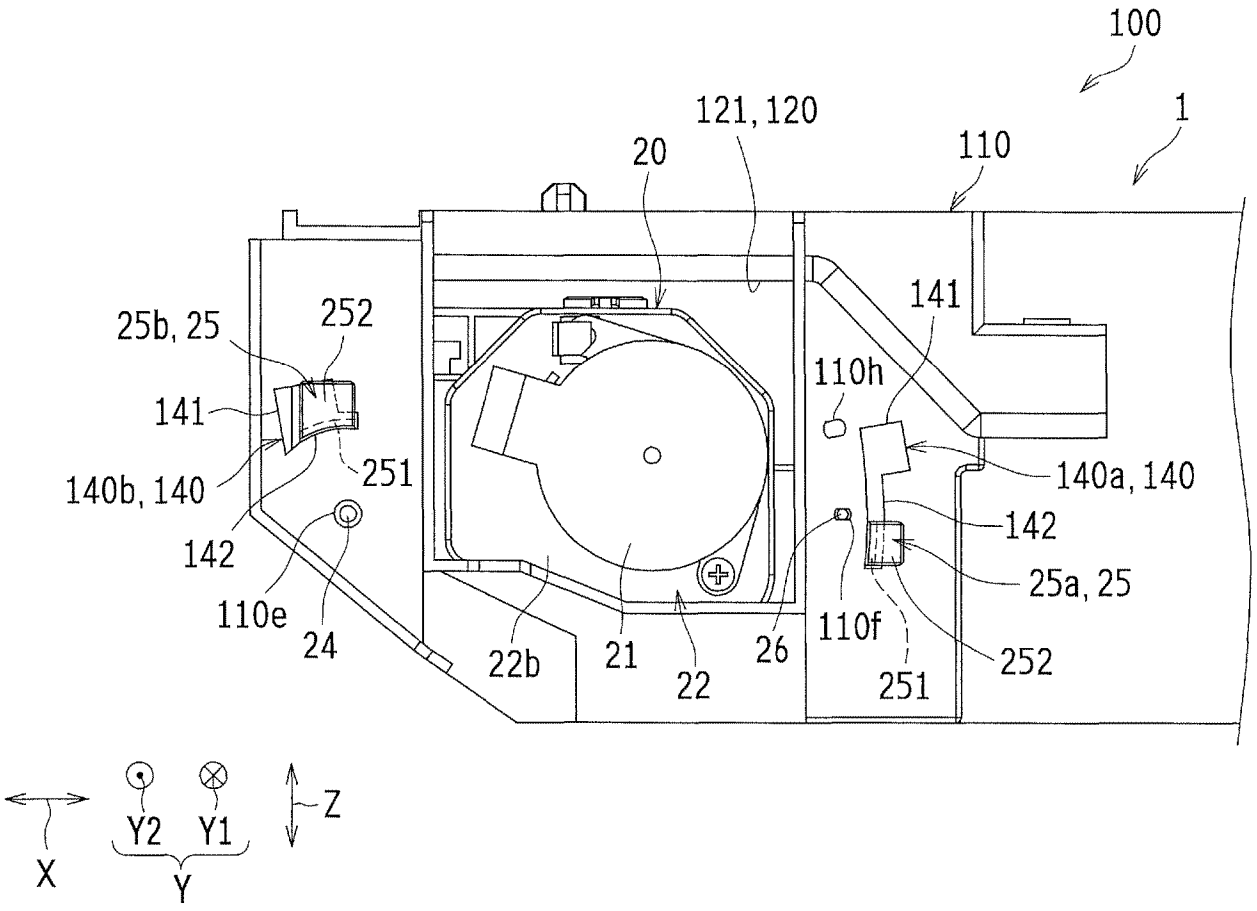
FIG. 17 is a schematic rear view illustrating a state in which the drive unit illustrated in FIG. 14 is attached to the rear-side frame member and secured to the rear-side frame member by the pawl portion.
Figure 18:
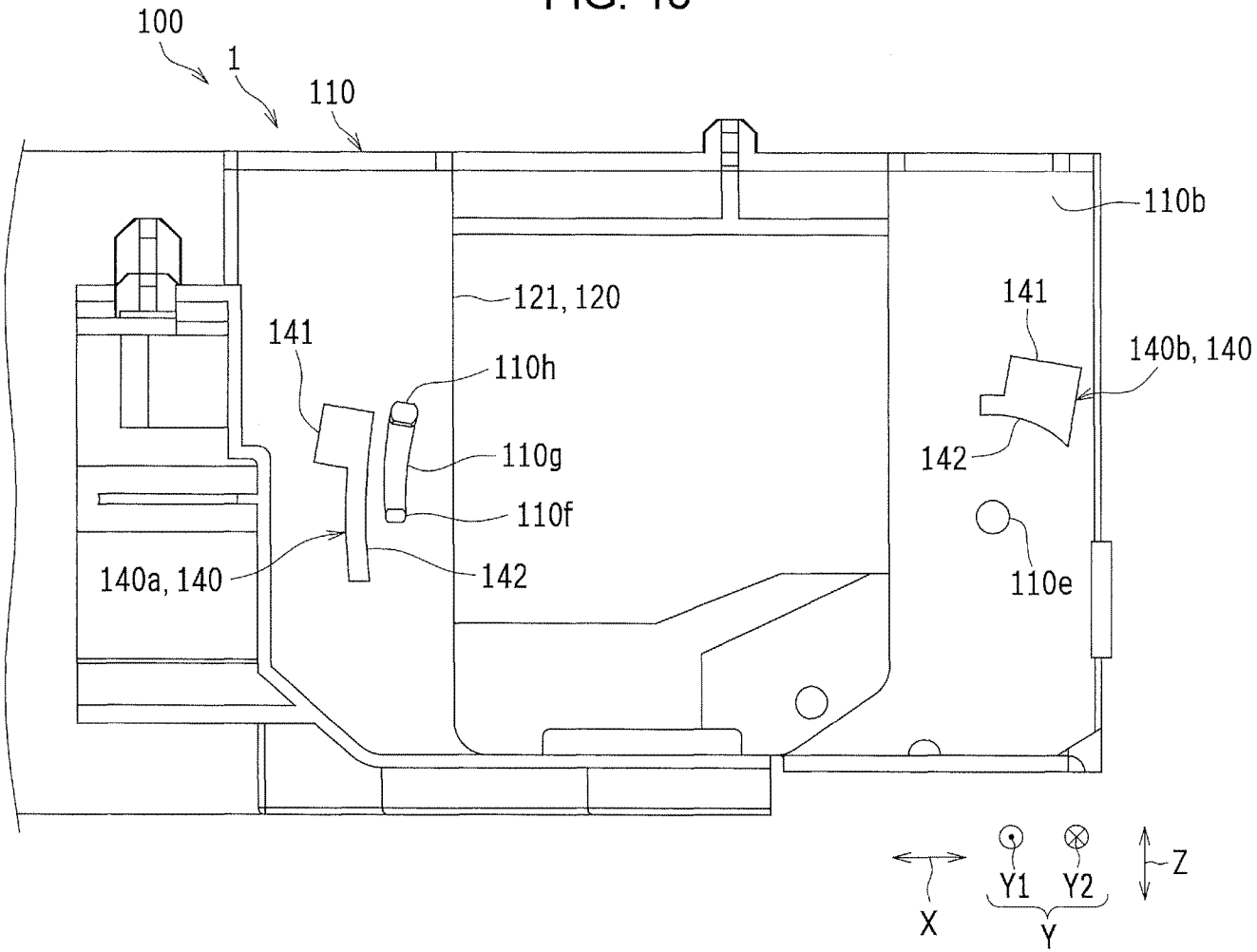
FIG. 18 is a schematic front view of the rear-side frame member illustrated in FIGS. 14, 16, and 17.
Figure 19:
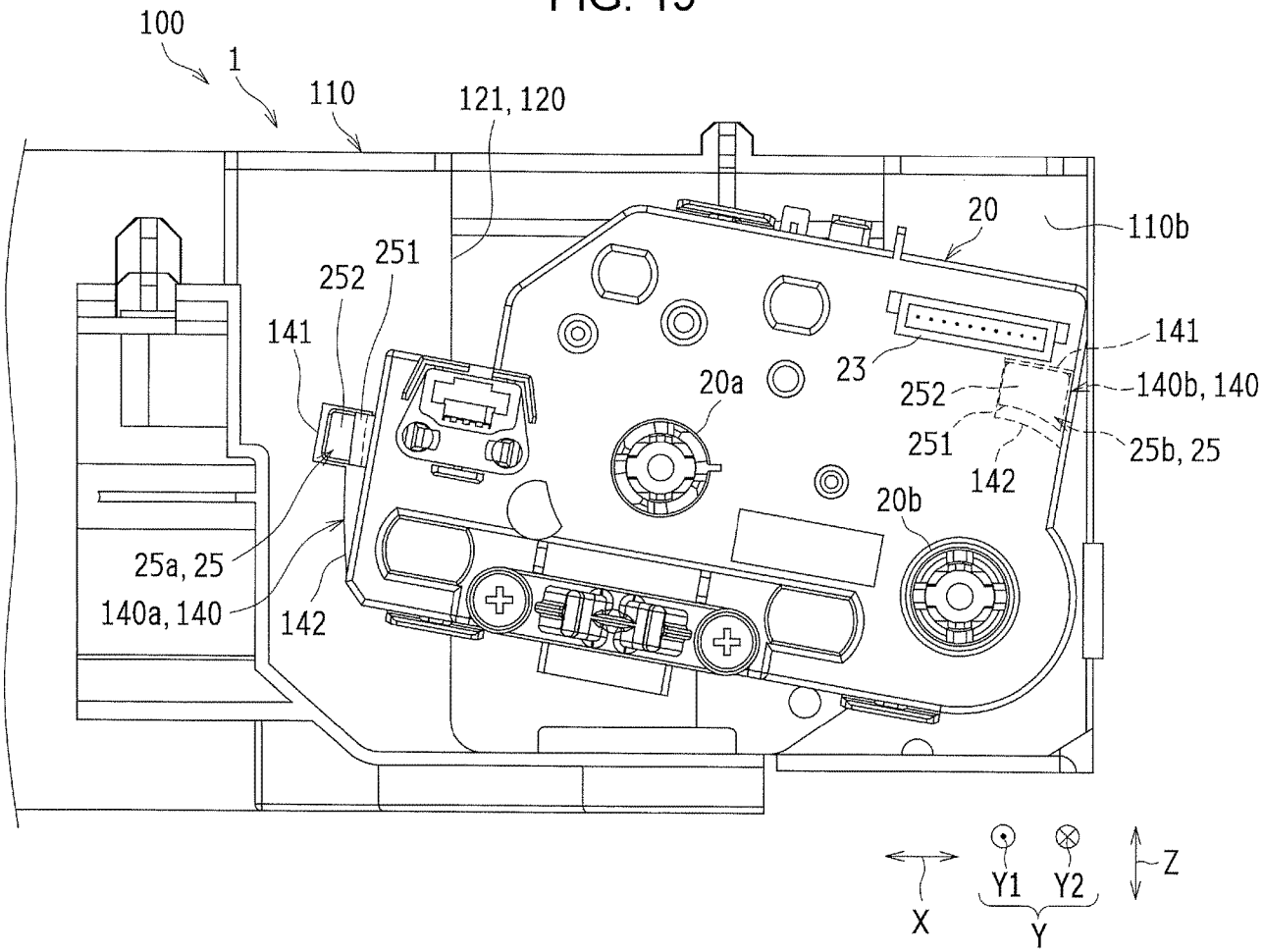
FIG. 19 is a schematic front view illustrating a state in which the drive unit illustrated in FIG. 16 that is attached to the rear-side frame member is not yet pawl-engaged with the rear-side frame member.

FIG. 17 is a schematic rear view illustrating a state in which the drive unit 20 illustrated in FIG. 14 is attached to the rear-side frame member 110 and secured to the rear-side frame member 110 by the pawl portion 25. FIG. 18 is a schematic front view of the rear-side frame member 110 illustrated in each of FIGS. 14, 16, and 17. FIG. 19 is a schematic front view illustrating a state in which the drive unit 20 illustrated in FIG. 16 that is attached to the rear-side frame member 110 is not yet pawl-engaged with the rear-side frame member 110.

Figure 20:
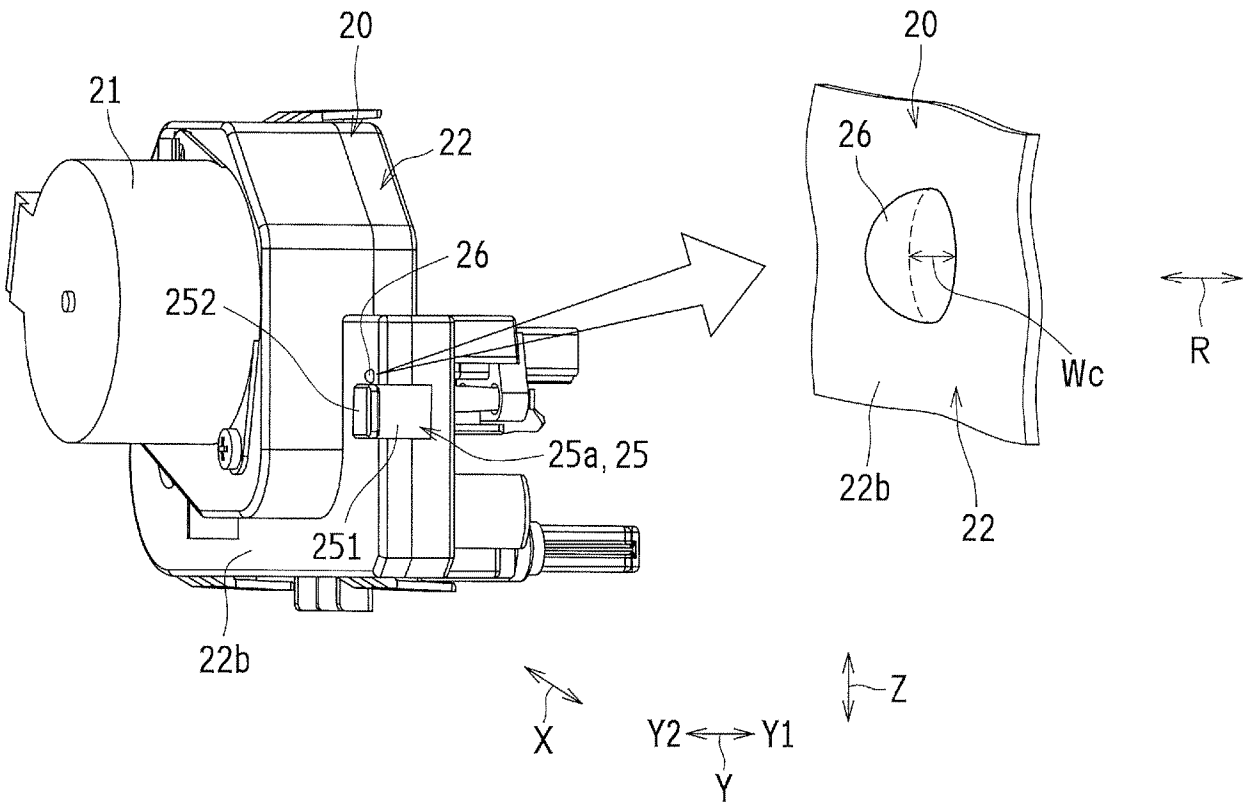
FIG. 20 is a schematic perspective view illustrating the drive unit illustrated in FIGS. 14 to 17 and 19 and illustrating, as an enlargement, a projecting portion of the drive unit.

FIG. 20 is a schematic perspective view illustrating the drive unit 20 illustrated in each of FIGS. 14 to 17 and 19 and illustrating, as an enlargement, a projecting portion 26 of the drive unit 20.

Note that members in the image forming apparatus 100 according to each of the sixth to eleventh embodiments having substantially identical configurations as those of the component members of the image forming apparatus 100 according to the first to fifth embodiments are given like reference numerals, and description of such members will be omitted.

In the image forming apparatus 100 according to the sixth embodiment, the drive unit 20 (refer to FIGS. 14 to 17, 19, and 20) may be configured to be detachably secured to the rear-side frame member 110 by being rotated about a rotational axis (specifically, a rotary shaft 24 (refer to FIGS. 14 to 17)) extending in a direction perpendicular or substantially perpendicular to the rear-side frame member 110.

Specifically, the drive unit 20 may be configured to be attached to the rear-side frame member 110 by being rotated in one direction (in the sixth embodiment, clockwise when viewed from the rear side Y2 in FIG. 16 and counter-clockwise when viewed from the front side Y1 in FIG. 19) about the rotational axis (specifically, the rotary shaft 24) and to be detached from the rear-side frame member 110 by being rotated in the other direction (in the sixth embodiment, counter-clockwise when viewed from the rear side Y2 in FIG. 16 and clockwise when viewed from the front side Y1 in FIG. 19) about the rotational axis (specifically, the rotary shaft 24).

As a result, it is possible to easily attach and detach the drive unit 20 to and from the rear-side frame member 110. Thus, it is possible to improve the efficiency of attaching and detaching the drive unit 20 to and from the rear-side frame member 110.

Specifically, the outer (rear side Y2) surface 22*b* (refer to FIGS. 14 to 17 and 20) of the support member 22 of the drive unit 20 has a shape extending along the inner (front side Y1) surface 110*b* (refer to FIGS. 18 and 19) of the rear-side frame member 110. The rotary shaft 24 is disposed on the outer (rear side Y2) surface 22*b* of the support member 22 and has a projecting shape that projects toward the front side Y1.

Non-limiting examples of the projecting shape of the rotary shaft 24 include a columnar projecting shape and a cylindrical projecting shape. In the sixth embodiment, the projecting shape of the rotary shaft 24 is the columnar projecting shape.

The rear-side frame member 110 is provided with an insertion portion 110*e* (refer to FIGS. 14 and 16 to 18) into which the rotary shaft 24 of the support member 22 of the drive unit 20 is inserted so as to be rotatable about the axis of the rotary shaft 24. The insertion portion 110*e* may be a through hole or a bottomed hole (recessed portion).

In the sixth embodiment, the insertion portion 110*e* is a through hole. The diameter of the insertion portion 110*e* is slightly larger (larger by a predetermined distance) than the diameter of the rotary shaft 24 by a degree that ensures insertion of the rotary shaft 24.

Seventh Embodiment

In the image forming apparatus 100 according to a seventh embodiment, the drive unit 20 may be configured to be detachably secured, by pawl engagement, to the rear-side frame member 110.

As a result, it is possible to detachably engage, by pawl engagement, the drive unit 20 and the rear-side frame member 110 with each other, which makes it easy to achieve a configuration in which the drive unit 20 is detachably secured to the rear-side frame member 110.

Specifically, one (in the seventh embodiment, the drive unit 20) of the drive unit 20 and the rear-side frame member 110 may be provided with the pawl portion 25 (refer to FIGS. 14 to 17, 19, and 20), and the other one (in the seventh embodiment, the rear-side frame member 110) of the drive unit 20 and the rear-side frame member 110 may be provided with a pawl lock portion 140 (refer to FIGS. 14 and 16 to 19) to be locked with the pawl portion 25.

More specifically, the support member 22 of the drive unit 20 is provided with a plurality of (two in the seventh embodiment) pawl portions 25*a* (25) and 25*b* (25). Each of the pawl portions 25*a* (25) and 25*b* (25) includes a first pawl portion 251 (refer to FIGS. 14 to 17, 19, and 20) and a second pawl portion 252 (refer to FIGS. 14 to 17, 19, and 20). Each first pawl portion 251 is disposed on the support member 22 so as to project from the support member 22 toward the rear side Y2. Each second pawl portion 252 is bent, at the right angle or a substantially right angle, at a top end portion of the first pawl portion 251 corresponding thereto outwardly in the radial direction of the axis of the rotary shaft 24.

The rear-side frame member 110 is provided with pawl lock portions 140*a* (140) and 140*b* (140) (refer to FIGS. 14 and 16 to 19) that lock the pawl portions 25*a* (25) and 25*b* (25) of the support member 22 of the drive unit 20. The pawl lock portions 140*a* (140) and 140*b* (140) may be through holes or bottomed holes (recessed grooves). In the seventh embodiment, the pawl lock portions 140 are through holes.

Each of the pawl lock portions 140*a* (140) and 140*b* (140) includes a first pawl lock portion 141 (refer to FIGS. 14 and 16 to 19) and a second pawl lock portion 142 (refer to FIGS. 14 and 16 to 19). Each first pawl lock portion 141 is configured such that both the corresponding first pawl portion 251 and the corresponding second pawl portion 252 are inserted therethrough. When rotated about the rotary shaft 24, each second pawl lock portion 142 is inserted by the first pawl portion 251 corresponding thereto and locks the second pawl portion 252 corresponding thereto. Thus, it is possible to secure the drive unit 20 in the rotational axis direction of the drive unit 20.

Each first pawl portion 251 has a circular arc shape that coincides with a locus of rotation about the axis of the rotary shaft 24. Each second pawl portion 252 has a plate shape extending in the left-right direction X and an up-down direction Z.

A distance between each second pawl portion 252 and the support member 22 is slightly larger (larger by a predetermined distance) than a thickness of the rear-side frame member 110 by a degree that ensures engagement of each second pawl portion 252 with the rear-side frame member 110.

The size of each first pawl lock portion 141 slightly larger (larger by a predetermined distance) than the size of the first pawl portion 251 and the size of the second pawl portion 252 by a degree that ensures insertion of the first pawl portion 251 and the second pawl portion 252. Each second pawl lock portion 142 has a circular arc shape that coincides with the locus of the rotation about the axis of the rotary shaft 24. The size of each second pawl lock portion 142 is slightly larger (larger by a predetermined distance) than the size of the first pawl portion 251 by a degree that ensures insertion of the first pawl portion 251.

In the seventh embodiment, the rotational axis (specifically, the rotary shaft 24) and the two second pawl portions 252 and 252 of the drive unit 20 are disposed on the support member 22 such that virtual straight lines that connect the rotational axis and the second pawl portions 252 and 252 form a triangular shape.

As a result, it is possible to effectively engage the drive unit 20 with the rear-side frame member 110.

Eighth Embodiment

Incidentally, the rotational position of the drive unit 20 about the rotational axis (specifically, the rotary shaft 24) may be restricted by pawl engagement (for example, the aforementioned pawl engagement); however, in this case, it may not be possible to accurately restrict the rotation of the drive unit 20.

Therefore, it is desirable to improve accuracy in the rotational position of the drive unit 20.

In this respect, in the image forming apparatus 100 according to the eighth embodiment, the rotation of the drive unit 20 about the rotational axis (specifically, the rotary shaft 24) may be restricted by recess-projection engagement with the rear-side frame member 110.

As a result, it is possible, due to the recess-projection engagement, to accurately restrict the rotation of the drive unit 20 about the rotational axis (specifically, the rotary shaft 24), which makes it possible to improve accuracy in the rotational position of the drive unit 20.

Ninth Embodiment

In the image forming apparatus 100 according to a ninth embodiment, one (in the ninth embodiment, the drive unit 20) of the drive unit 20 and the rear-side frame member 110 may be provided with the projecting portion 26 (refer to FIGS. 14 to 17 and 20), and the other one (in the ninth embodiment, the rear-side frame member 110) of the drive unit 20 and the rear-side frame member 110 may be provided with a lock portion 110*f* (refer to FIGS. 14 and 16 to 18) that is locked with the projecting portion 26. The rotation of the drive unit 20 of the image forming apparatus 100 about the rotational axis (specifically, the rotary shaft 24) is restricted by the engagement between the projecting portion 26 and the lock portion 110*f*.

As a result, it is possible to easily provide the projecting portion 26 on one (the drive unit 20 in the ninth embodiment) of the drive unit 20 and the rear-side frame member 110, and it is also possible to easily provide the lock portion 110*f* on the other one (the rear-side frame member 110 in the ninth embodiment) of the drive unit 20 and the rear-side frame member 110. Thus, it is possible to easily achieve the engagement between the drive unit 20 and the rear-side frame member 110.

Specifically, the projecting portion 26 is disposed on the outer (rear side Y2) surface 22*b* of the support member 22 of the drive unit 20. The projecting portion 26 has a projecting shape that projects toward the front side Y1.

Non-limiting examples of the shape of the projecting portion 26 include a semi-spherical (semi-circular in the side view) shape, a circular arc shape in the side view, an oval arc shape in the side view, a conical (triangular in the side view) shape, a pyramid (triangular in the side view) shape, a frustoconical shape (trapezoidal in the side view), and a truncated pyramid shape (trapezoidal in side view). In the ninth embodiment, the shape of the projecting portion 26 is substantially semi-spherical (substantially semi-circular in side view).

The lock portion 110' is disposed on the inner surface 110*b* of the rear-side frame member 110. The lock portion 110*f* may be a through hole or a bottomed hole (recessed portion). In the ninth embodiment, the lock portion 110*f* is a through hole.

Specifically, the projecting portion 26 may be disposed on the rear-side frame member 110 so as to be at a position (specifically, opposite the rotational axis (specifically, the rotary shaft 24) of the drive unit 20 with the drive part 21 interposed therebetween) as far as possible from the rotational axis (specifically, the rotary shaft 24) of the drive unit 20.

As a result, it is possible to accurately restrict the rotation of the drive unit 20 about the rotational axis (specifically, the rotary shaft 24).

Tenth Embodiment

In the image forming apparatus 100 according to a tenth embodiment, the other one (the rear-side frame member 110 in the tenth embodiment) of the drive unit 20 and the rear-side frame member 110 may be further provided with a guide groove 110*g* (refer to FIG. 18) that guides the projecting portion 26 to the lock portion 110*f*.

As a result, it is possible to guide the projecting portion 26 to the lock portion 110*f* along the guide groove 110*g*, which ensures locking of the projecting portion 26 to the lock portion 110*f*.

Figure 21:
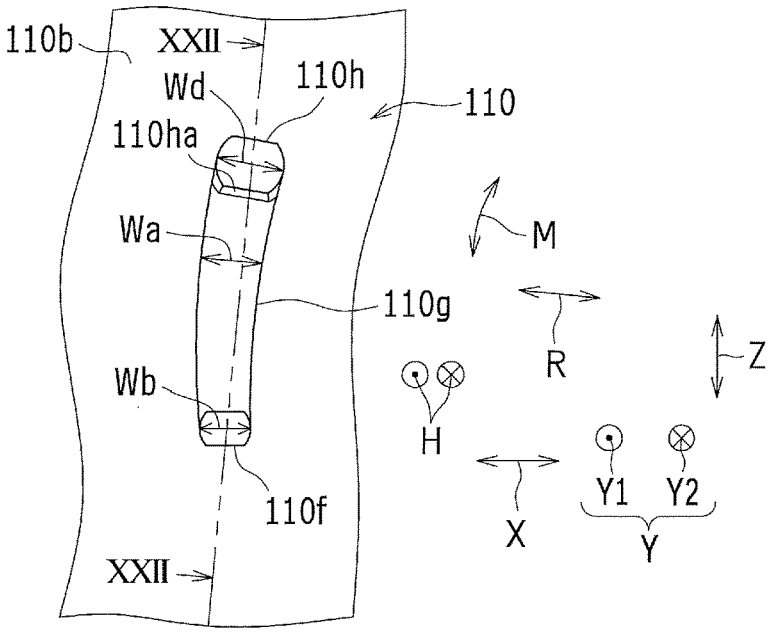
FIG. 21 is an enlarged schematic front view illustrating a portion including a lock portion and a guide groove illustrated in FIG. 18.
Figure 22:
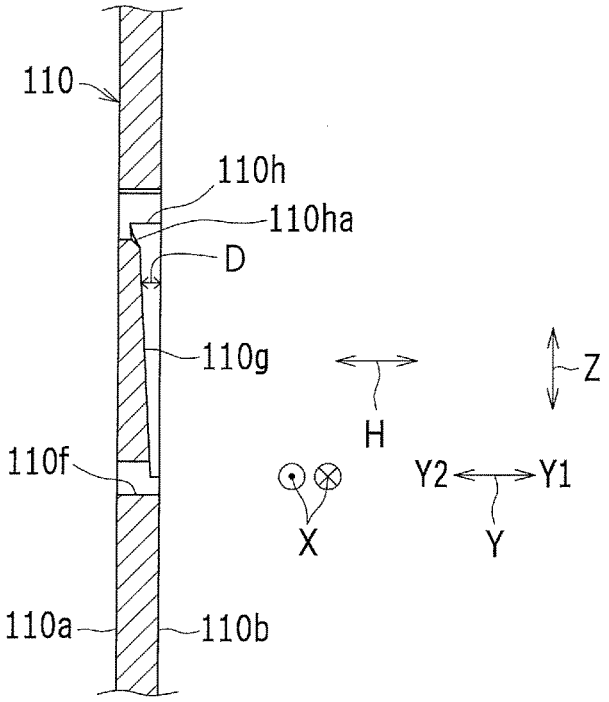
FIG. 22 is a schematic sectional view of a portion including the lock portion and the guide groove illustrated in FIG. 21, taken along line XXII-XXII.
Figure 23:
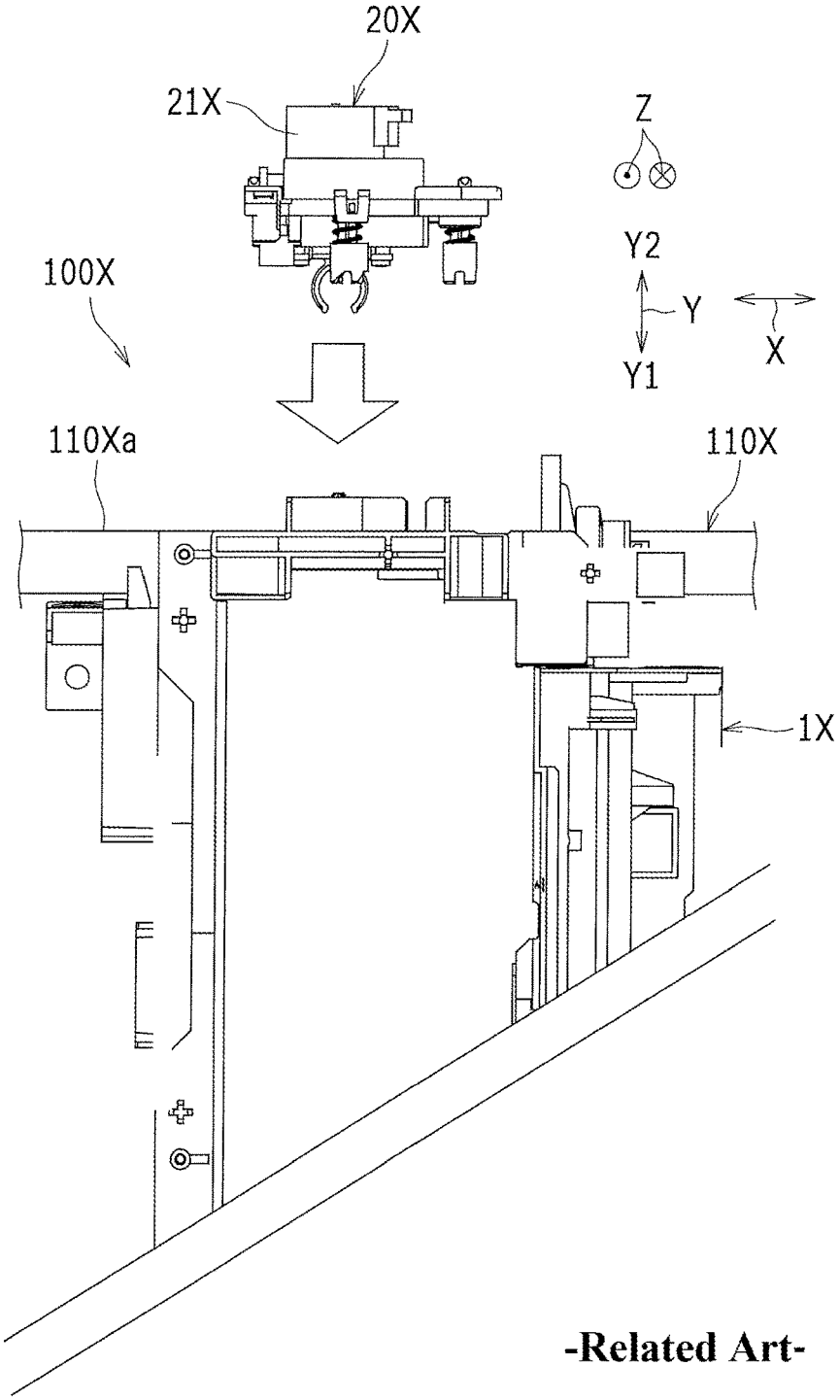
FIG. 23 is a schematic plan view illustrating a state in which a drive unit is to be disposed on an outer surface of a rear-side frame member of a known image forming apparatus.
Figure 24:
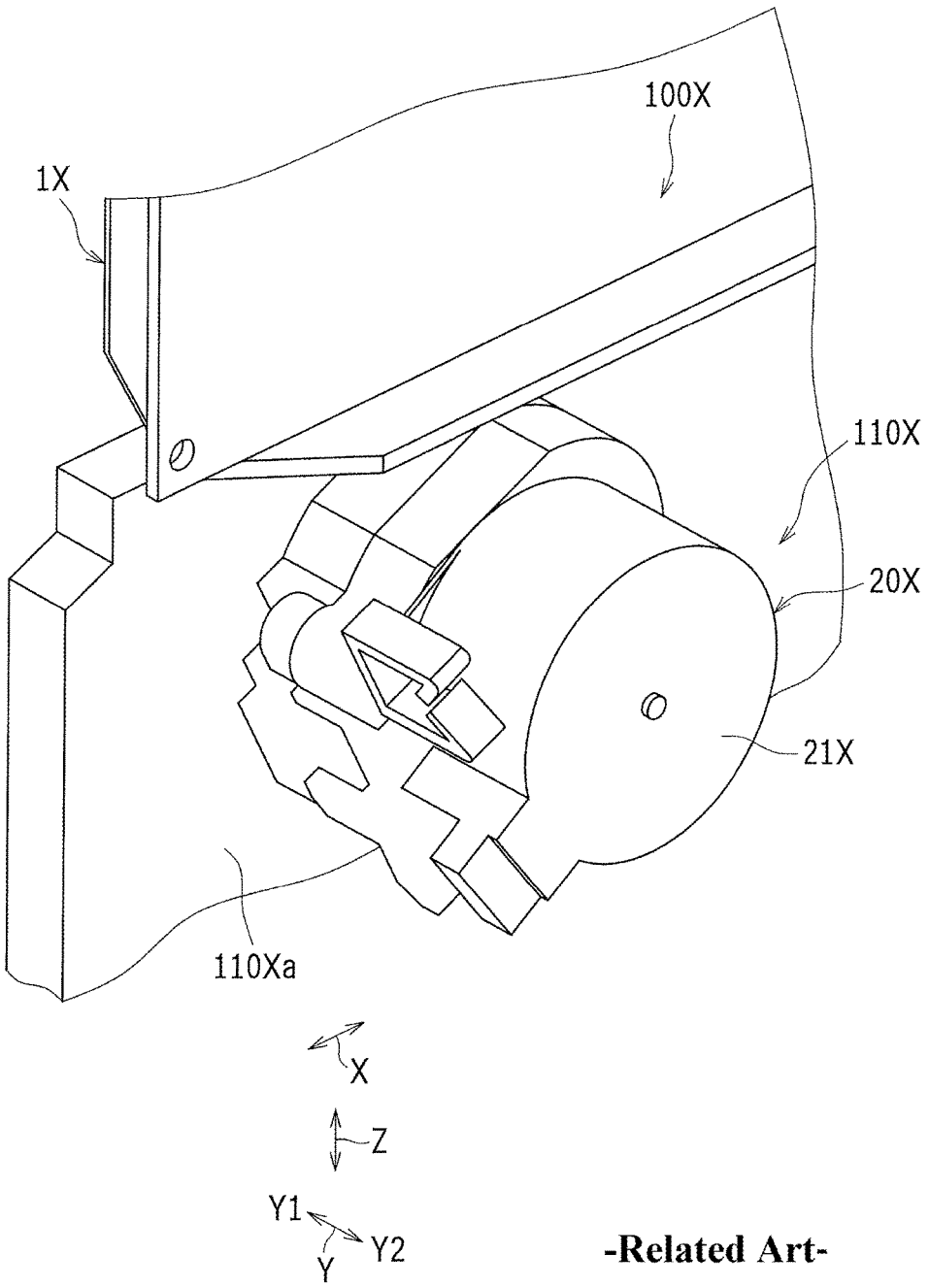
FIG. 24 is a schematic perspective view, obliquely from above and on a rear side, illustrating a state in which the drive unit illustrated in FIG. 23 is disposed on the outer surface of the rear-side frame member.

Specifically, the lock portion 110*f* and the guide groove 110*g* are configured as illustrated in FIGS. 21 and 22.

FIG. 21 is an enlarged schematic front view illustrating a portion including the lock portion 110*f* and the guide groove 110*g* illustrated in FIG. 18. FIG. 22 is a schematic sectional view of a portion including the lock portion 110*f* and the guide groove 110*g* illustrated in FIG. 21, taken along line XXII-XXII.

The guide groove 110*g* is disposed on the inner surface 110*b* of the rear-side frame member 110. The lock portion 110*f* communicates with one end (a guide outlet end that guides the projecting portion 26 to the lock portion 110*f*) of the guide groove 110*g*.

The guide groove 110*g* has a circular arc shape that coincides with the locus of the rotation of the drive unit 20 about the rotational axis (specifically, the axis of the rotary shaft 24).

As a result, it is possible to ensure guiding of the projecting portion 26 along the guide groove 110*g* having the circular arc shape that coincides with the locus of the rotation of the drive unit 20.

The guide groove 110*g* has a width Wa (refer to FIG. 21) that increases as a distance from the lock portion 110*f* increases.

As a result, it is possible, at the other end opposite the lock portion 110*f* (a guide inlet end that guides the projecting portion 26 to the lock portion 110*f*) of the guide groove 110*a*, to easily receive the projecting portico 26 in the other end (guide inlet end) of the guide groove 110*g* in a radial direction R (refer to FIGS. 20 and 21) of the rotary shaft 24.

Incidentally, a size Wb (refer to FIG. 21) of the lock portion 110*f* in the radial direction R may be equal or substantially equal to a size Wc (refer to FIG. 20) of the projecting portion 26 in the radial direction R; however, in this case, if there is a dimensional difference between the rotary shaft 24 and the projecting portion 26, it is difficult to tolerate the dimensional difference. In this case, it is not possible to ensure the engagement of the projecting portion 26 with the lock portion 110*f*.

Thus, it is desirable to tolerate the dimensional difference between the rotary shaft 24 and the projecting portion 26.

In this respect, the size Wb of the lock portion 110*f* in the radial direction R is slightly larger (larger by a predetermined distance that enables toleration of the dimensional difference between the rotary shaft 24 and the projecting portion 26) than the size Wc of the projecting portion 26 in the radial direction R.

As a result, even if there is a dimensional difference between the rotary shaft 24 and the projecting portion 26, it is possible to tolerate the dimensional difference, which ensures engagement of the projecting portion 26 with the lock portion 110*f*.

The lock portion 110*f* has, for example, a shape (commonly known as an oval shape) having two substantially straight line portions that face each other and extend in the radial direction R with a gap interposed therebetween, the gap being slightly larger (larger by a predetermined distance that ensures insertion of the projecting portion 26) in a circumferential direction M (refer to FIG. 21) of the rotary shaft 24 than the size of the projecting portion 26; and circular arc portions that are connected to both ends of the substantially parallel straight line portions so as to correspond to the circular arc shape of the projecting portion 26.

The width Wa of the guide groove 110*g* is equal or substantially equal, at one end (guide outlet end) of the guide groove 110*g* on the lock portion 110*f* side, to the size Wb of the lock portion 110*f* in the radial direction R.

As a result, it is possible to smoothly move the projecting portion 26 from the one end (guide outlet end) of the guide groove 110*g* to the lock portion 110*f*.

The width Wa of the guide groove 110*g* is larger (larger by a predetermined distance that enables the projecting portion 26 to be smoothly guided from the other end (guide inlet end) of the guide groove 110*g* along the guide groove 110 at the other end (guide inlet end) of the guide groove 110*g* than the size Wb of the lock portion 110*f*.

As a result, it is possible to smoothly guide the projecting portion 26 from the other end (guide inlet end) of the guide groove 110*g* along the guide groove 110*g*.

The guide groove 110*g* has a depth D (refer to FIG. 22) that increases as a distance from the lock portion 110*f* increases.

As a result, it is possible, at the other end (guide inlet end) of the guide groove 110*g*, to easily receive the projecting portion 26 in the guide groove 110*g* in a thickness direction H (depth direction Y).

The guide groove 110*g* may be inclined linearly or may have curved shape projecting upward or projecting downward. In the tenth embodiment, the guide groove 110*g* is inclined linearly.

Eleventh Embodiment

In the image forming apparatus 100 according to an eleventh embodiment, the other one (in the eleventh embodiment, the inner surface 110*b* of the rear-side frame member 110) of the drive unit 20 and the rear-side frame member 110 may be provided with a temporary placement portion 110*h* (refer to FIGS. 18, 21, and 22) for temporarily placing the projecting portion 26 thereon.

As a result, it is possible to temporarily place the projecting portion 26 on the temporary placement portion 110*h* before the projecting portion 26 is guided along the guide groove 110*g*, which ensures guiding of the projecting portion 26 to the vicinity of the other end (guide inlet end) of the guide groove 110*g*.

The temporary placement portion 110*h* may be a through hole or may be a bottomed hole (recessed portion). In the eleventh embodiment, the temporary placement portion 110*h* is a through hole.

The temporary placement portion 110*h* communicates with the other end (guide inlet end) of the guide groove 110*g*. The temporary placement portion 110*h* has a size Wd (refer to FIG. 21) in the radial direction R. The size Wd is equal or substantially equal to the width Wa of the other end (guide inlet end) of the guide groove 110*a*.

As a result, it is possible to smoothly move the projecting portion 26 from the other end (guide inlet end) of the guide groove 110*g* into the guide groove 110*g*.

The temporary placement portion 110*h* includes an inclined portion 110*ha* (refer to FIGS. 21 and 22) that communicates with the guide groove 110*g*. The height of the inclined portion 110*ha* in the thickness direction H (depth direction Y) gradually increases toward the guide groove 110*g*.

As a result, it is possible to more smoothly move the projecting portion 26 from the temporary placement portion 110 to the guide groove 110*g* via the inclined portion 110*ha*.

An example of the shape of the temporary placement portion 110*h* is a shape (commonly known as an oval shape) having two substantially straight line portions that face each other and extend in the radial direction R with a gap interposed therebetween, the gap being larger (larger by a predetermined distance that ensures placing of the projecting portion 26 in the vicinity of the other end (guide inlet end) of the guide groove 110*g*) in the circumferential direction M than the size of the projecting portion 26; and circular arc portions that are connected to both ends of the two straight line portions so as to correspond to the circular arc shape of the projecting portion 26.

Attaching/Detaching of Drive Unit to/from Rear-side Frame Member

In the aforementioned image forming apparatus 100, the drive unit 20 is attached to the rear-side frame member 110 from the front side Y1 as described below. First, the rotary shaft 24 of the drive unit 20 is inserted, toward the rear side Y2, into the insertion portion 110*e* of the rear-side frame member 110. Then, the projecting portion 26 of the drive unit 20 is temporarily placed on the temporary placement portion 110*h* of the rear-side frame member 110. Next, the drive unit 20 is rotated in one direction (in the eleventh embodiment, clockwise when viewed from the rear side Y2 in FIG. 16 and counter-clockwise when viewed from the front side Y1 in FIG. 19) about the rotary shaft 24, and at the same time, the projecting portion 26 is moved from the temporary placement portion 110*h* toward the lock portion 110*f* along the guide groove 110*g* so that the pawl portions 25*a* (25) and 25*b* (25) of the drive unit 20 are locked with the pawl lock portions 140*a* (140) and 140*b* (140) of the rear-side frame member 110, respectively. Then, the projecting portion 26 of the drive unit 20 is locked with the lock portion 110*f* of the rear-side frame member 110. Thus, the drive unit 20 is attached to the rear-side frame member 110.

The drive unit 20 is detached from the rear-side frame member 110 from the front side Y1 as described below. First, the drive unit 20 is pulled slightly toward the front side Y1 to release the engagement between the projecting portion 26 of the drive unit 20 and the lock portion 110*f* of the rear-side frame member 110, and at the same time, the drive unit 20 is rotated in the other direction (in the eleventh embodiment, counter-clockwise when viewed from the rear-side Y2 in FIG. 16 and clockwise when viewed from the front side Y1 in FIG. 19) about the rotary shaft 24. Next, the projecting portion 26 of the drive unit 20 is moved from the lock portion 110*f* of the rear-side frame member 110 toward the temporary placement portion 110*h* along the guide groove 110*g*, and at the same time, the engagement of each of the pawl portions 25*a* (25) and 25*b* (n) of the drive unit 20 with the respective pawl lock portions 140*a* (140) and 140*b* (140) of the rear-side frame member 110 is released. Then, the rotary shaft 24 of the drive unit 20 is extracted from the insertion portion 110*e* of the rear-side frame member 110 toward the front side Y1. Thus, the drive unit 20 is detached from the rear-side frame member 110.

In the embodiments, a drive device that drives a toner storage part (specifically, a toner cartridge) is presented as an example of the drive unit according to the present disclosure; however, the drive unit according to the present disclosure is also employed as a drive device that drives various types of devices and units used in an image forming apparatus, for example, as a transfer unit and a process unit that includes a developing device, a fixing device, and a photoreceptor.

The present disclosure is not limited to the embodiments described above and can be carried out in other various forms. Therefore, such embodiments are merely examples in all aspects and are not to be restrictively interpreted. The scope of the present disclosure is indicated by the claims and is not restricted by the content of the specification. Further, all modifications and alterations belonging to a scope equivalent to the claims are included in the scope of the present disclosure.

The present disclosure contains subject matter related to that disclosed in Japanese Priority Patent Application JP 2017-080830 filed in the Japan Patent Office on Apr. 14, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus comprising:

a rear-side frame member that is disposed on a rear side of an image forming apparatus body so as to extend in a vertical or substantially vertical direction; and a drive unit that includes a drive part, wherein the drive unit is detachably disposed on an inner surface of the rear-side frame member such that the drive part faces outward from the image forming apparatus body, wherein the rear-side frame member is provided with an avoiding portion that avoids interference of the rear-side frame member with the drive part of the drive unit, and wherein the avoiding portion is a recessed portion that covers the drive part of the drive unit.

2. The image forming apparatus according to claim 1, wherein the drive part of the drive unit is an electric drive part, wherein a connector is electrically connected to the drive part, the connector being disposed on the drive unit such that a connected side of the connector faces a front side of the image forming apparatus body, and wherein the drive part is electrically connected to the image forming apparatus body via the connector.

3. The image forming apparatus according to claim 1, wherein the drive unit is configured to be detachably secured to the rear-side frame member by being rotated about a rotational axis extending in a direction perpendicular or substantially perpendicular to the rear-side frame member.

4. The image forming apparatus according to claim 3, wherein the drive unit is configured to be detachably secured, by pawl engagement, to the rear-side frame member.

5. The image forming apparatus according to claim 3, wherein rotation of the drive unit about the rotational axis is restricted by recess-projection engagement with the rear-side frame member.

6. An image forming apparatus comprising:

a rear-side frame member that is disposed on a rear side of an image forming apparatus body so as to extend in a vertical or substantially vertical direction; and a drive unit that includes a drive part, wherein the drive unit is detachably disposed on an inner surface of the rear-side frame member such that the drive part faces outward from the image forming apparatus body, and wherein the rear-side frame member includes a surrounding portion that surrounds the drive part of the drive unit.

7. The image forming apparatus according to claim 6, wherein the drive part of the drive unit is an electric drive part, wherein a connector is electrically connected to the drive part, the connector being disposed on the drive unit such that a connected side of the connector faces a front side of the image forming apparatus body, and wherein the drive part is electrically connected to the image forming apparatus body via the connector.

8. The image forming apparatus according to claim 6, wherein the drive unit is configured to be detachably secured to the rear-side frame member by being rotated about a rotational axis extending in a direction perpendicular or substantially perpendicular to the rear-side frame member.

9. The image forming apparatus according to claim 8, wherein the drive unit is configured to be detachably secured, by pawl engagement, to the rear-side frame member.

10. The image forming apparatus according to claim 8, wherein rotation of the drive unit about the rotational axis is restricted by recess-projection engagement with the rear-side frame member.

11. The image forming apparatus according to claim 10, wherein one of the drive unit and the rear-side frame member is provided with a projecting portion, wherein another one of the drive unit and the rear-side frame member is provided with a lock portion that is to be locked with the projecting portion, and wherein the rotation of the drive unit about the rotational axis is restricted by engagement between the projecting portion and the lock portion.

12. The image forming apparatus according to claim 11, wherein the other one of the drive unit and the rear-side frame member is further provided with a guide groove that guides the projecting portion to the lock portion.

13. The image forming apparatus according to claim 11, wherein the other one of the drive unit and the rear-side frame member is provided with a temporary placement portion for temporarily placing the projecting portion thereon.

14. An image forming apparatus comprising:

a rear-side frame member that is disposed on a rear side of an image forming apparatus body so as to extend in a vertical or substantially vertical direction; and a drive unit that includes a drive part, wherein the drive unit is detachably disposed on an inner surface of the rear-side frame member such that the drive part faces outward from the image forming apparatus body, wherein the drive part of the drive unit is an electric drive part, wherein a connector is electrically connected to the drive part, the connector being disposed on the drive unit such that a connected side of the connector faces a front side of the image forming apparatus body, and wherein the drive part is electrically connected to the image forming apparatus body via the connector.

15. The image forming apparatus according to claim 14, wherein the drive unit is configured to be detachably secured to the rear-side frame member by being rotated about a rotational axis extending in a direction perpendicular or substantially perpendicular to the rear-side frame member.

16. The image forming apparatus according to claim 15, wherein the drive unit is configured to be detachably secured, by pawl engagement, to the rear-side frame member.

17. The image forming apparatus according to claim 15, wherein rotation of the drive unit about the rotational axis is restricted by recess-projection engagement with the rear-side frame member.

18. An image forming apparatus comprising:

a rear-side frame member that is disposed on a rear side of an image forming apparatus body so as to extend in a vertical or substantially vertical direction; and a drive unit that includes a drive part, wherein the drive unit is detachably disposed on an inner surface of the rear-side frame member such that the drive part faces outward from the image forming apparatus body, and wherein the drive unit is configured to be detachably secured to the rear-side frame member by being rotated about a rotational axis extending in a direction perpendicular or substantially perpendicular to the rear-side frame member.

19. The image forming apparatus according to claim 18, wherein the drive unit is configured to be detachably secured, by pawl engagement, to the rear-side frame member.

20. The image forming apparatus according to claim 18, wherein rotation of the drive unit about the rotational axis is restricted by recess-projection engagement with the rear-side frame member.

* * * * *